US008800817B2

(12) United States Patent
Norris et al.

(10) Patent No.: US 8,800,817 B2
(45) Date of Patent: Aug. 12, 2014

(54) BEVERAGE DISPENSING DEVICE

(75) Inventors: Joseph T. Norris, Cumming, GA (US); Quande Gui, Shanghai (CN); Feiyun Ma, Shanghai (CN); Xiaoliang Tan, Shanghai (CN); Javier Verdura, Milford, CT (US); Jesse S. Kruska, New Haven, CT (US); John Kevin Clay, Milford, CT (US); James McCay, Fairfield, CT (US); Jon Crawford-Phillips, Rumson, NJ (US); Rony Zibara, New York, NY (US); Viresh Chopra, Brooklyn, NY (US); Georgina Louise Clarke, Brooklyn, NY (US)

(73) Assignee: The Coca-Cola Company, Atlanta, GA (US)

( * ) Notice: Subject to any disclaimer, the term of this patent is extended or adjusted under 35 U.S.C. 154(b) by 4 days.

(21) Appl. No.: 13/273,140

(22) Filed: Oct. 13, 2011

(65) Prior Publication Data

US 2012/0138635 A1 Jun. 7, 2012

Related U.S. Application Data

(60) Provisional application No. 61/419,977, filed on Dec. 6, 2010.

(51) Int. Cl.
*B67D 7/06* (2010.01)

(52) U.S. Cl.
USPC ..... 222/131; 222/183; 222/185.1; 222/132; 222/146.6

(58) Field of Classification Search
CPC ... B67D 3/0009; B67D 3/0038; B67D 3/0035
USPC ..... 62/390; 222/129, 129.1, 130, 143, 222/146.1, 131, 146.2, 146.6, 183, 185.1, 222/132
See application file for complete search history.

(56) References Cited

U.S. PATENT DOCUMENTS 2,070,398 A * 2/1937 Freund ..... 62/398
2,274,409 A * 2/1942 Harbison ..... 222/183

(Continued)

FOREIGN PATENT DOCUMENTS

| | | |
|---|---|---|
| EP | 0559924 | 9/1993 |
| GB | 2286384 | 8/1995 |
| GB | 2335412 | 9/1999 |

OTHER PUBLICATIONS

International Search Report and Written Opinion for related International Application No. PCT/US2011/63493 mailed Apr. 25, 2012.

*Primary Examiner* — Paul R Durand
*Assistant Examiner* — Donnell Long
(74) *Attorney, Agent, or Firm* — Sutherland Asbill & Brennan LLP

(57) ABSTRACT

A beverage dispenser that is enabled for on demand, gravity fed dispensing of a pre-mixed or otherwise ready to drink beverage that has been thermally regulated through natural convection. More specifically, the beverage dispenser enables pre-mixed or otherwise ready to drink beverage containers (i.e., beverage containers with beverage contents that are pre-mixed or otherwise ready to drink) to be installed on the beverage dispenser and, without the aid of electricity or electro-mechanical devices, dispense a thermally regulated beverage on-demand to an intended customer. The beverage dispenser may comprise a thermal regulation compartment that facilitates regulating the temperature of beverage contents through natural convection. The beverage dispenser may also comprise a thermally regulated and thermally insulated beverage enclosure in which to install the beverage containers. The thermal regulation compartment may be carried within the beverage enclosure.

25 Claims, 26 Drawing Sheets

(56) References Cited

U.S. PATENT DOCUMENTS

| | | | | | |
|---|---|---|---|---|---|
| 2,681,747 | A | * | 6/1954 | Norris et al. | 222/185.1 |
| 3,178,064 | A | * | 4/1965 | Layne | 222/105 |
| 3,212,681 | A | * | 10/1965 | Weikert | 222/183 |
| 3,243,084 | A | * | 3/1966 | Stegner | 222/95 |
| 3,285,474 | A | * | 11/1966 | Gran | 222/131 |
| 3,837,533 | A | * | 9/1974 | Splan | 222/94 |
| 4,610,145 | A | * | 9/1986 | Arzberger et al. | 62/127 |
| 5,025,955 | A | | 6/1991 | Stenger | |
| 5,619,856 | A | | 4/1997 | Lee | |
| 6,026,988 | A | * | 2/2000 | Teetsel, III et al. | 222/88 |
| 6,073,811 | A | | 6/2000 | Costea | |
| 6,112,537 | A | * | 9/2000 | Broadbent | 62/293 |
| 6,223,944 | B1 | * | 5/2001 | Gehl et al. | 222/94 |
| 6,450,214 | B1 | | 9/2002 | Dyer et al. | |
| 6,497,343 | B1 | * | 12/2002 | Teetsel, III | 222/1 |
| 6,892,903 | B1 | | 5/2005 | Bartolotta | |
| 8,113,248 | B2 | * | 2/2012 | Lee et al. | 141/358 |
| 8,313,007 | B2 | * | 11/2012 | Kpabar | 222/108 |
| 2004/0177893 | A1 | | 9/2004 | Younkle | |
| 2004/0195393 | A1 | | 10/2004 | Younkle | |
| 2005/0072487 | A1 | | 4/2005 | Younkle | |
| 2006/0091129 | A1 | | 5/2006 | Colonna | |
| 2008/0277417 | A1 | | 11/2008 | Groesbeck | |
| 2009/0320517 | A1 | * | 12/2009 | Lavallee | 62/457.2 |
| 2010/0077773 | A1 | | 4/2010 | Sherman | |

* cited by examiner

BEVERAGE DISPENSING DEVICE

PRIORITY

This application claims priority under 35 U.S.C. 119(e) to provisional application 61/419,977 filed on Dec. 6, 2010, which is hereby incorporated by reference in its entirety.

TRADEMARKS

COCA-COLA® is a registered trademark of The Coca-Cola Company, Atlanta, Ga., U.S.A. Other names used herein may be registered trademarks, trademarks or product names of The Coca-Cola Company or other companies.

TECHNICAL FIELD

The present disclosure relates generally to a beverage dispenser for on demand, gravity fed or gravity driven dispensing of a pre-mixed or otherwise ready to drink beverage that has been thermally regulated through natural convection. The present disclosure more particularly relates to a beverage dispenser that enables pre-mixed or otherwise ready to drink beverage containers (i.e., beverage containers with beverage contents that are pre-mixed or otherwise ready to drink) to be attached to the beverage dispenser and, without the aid of electricity or electro-mechanical devices, enables dispensing a thermally regulated beverage on-demand to an intended customer.

BACKGROUND

Beverage delivery to on-demand point of purchase or point of thirst customers, such as fountain drink customers, in some locales has heretofore not been achieved in an efficient, cost-effective, easily re-producible manner. In developed countries such on-demand beverage delivery typically occurs through complex electro-mechanical beverage dispensers. Such electro-mechanical beverage dispensers may mix multiple ingredients, such as a syrup concentrate and a diluent, at the point of dispensing the beverage. For example, an electro-mechanical beverage dispenser may mix COCA-COLA® syrup with carbonated water as the COCA-COLA® beverage is being dispensed.

In developing locales, such electro-mechanical beverage dispensers may not be suitable. Such non-suitability may exist because of the size or cost of the beverage dispensers, lack of reliable electrical resources to power the beverage dispensers, and/or lack of supply chains or infrastructure suitable to reliably deliver the required ingredients to mix the beverages. For example, large bag-in-box syrups and food grade $CO_2$ containers often used in electro-mechanical beverage dispensers may not be readily available in some locales. Further, potable water supplies may not be readily available.

In some developing locales customers may be serviced with returnable, refillable containers. For example, a customer may enter a merchant location, purchase a beverage for consumption, and be supplied with a refillable container, such as a glass bottle, containing the purchased beverage. The customer may be unable to remove the beverage-filled glass bottle from the merchant location because the glass bottle may remain the property of a beverage company supplying the merchant or the merchant themselves. Therefore, the customer may be required to consume the entirety of the beverage at the merchant location and return the glass bottle. Alternatively, the customer may transfer the beverage from the glass bottle to another container carried or otherwise owned by the customer and return the glass bottle.

Because each container may be returned for a deposit, some customers may not be able to purchase the container with the beverage so that the customer may enjoy the beverage at their leisure rather than being constrained to the merchant location as described above. Also, some customers may not want to or be able to pay for the entire amount of beverage within the container. Accordingly, use of the aforementioned returnable, refillable containers may limit the consumer base in some locales.

SUMMARY

In one aspect, the invention includes a beverage dispenser comprising a dispensing shelf configured to support installation of one or more ready to drink beverage containers for gravity fed beverage dispensing. The beverage dispenser further comprises a thermal regulant storage area adapted to store a thermal regulant that regulates the temperature of beverage contents of the one or more beverage containers through natural convection.

The beverage dispenser of claim 1, further comprising:

In some embodiments, the beverage dispenser further comprises a thermally insulated beverage compartment that encloses the thermal regulant storage area and at least a portion of the dispensing shelf configured to support installation of one or more ready to drink beverage containers.

In some embodiments, the beverage dispenser further comprises a pre-regulating compartment below the thermally insulated beverage compartment and adapted to store one or more beverage containers.

In some embodiments, the dispensing shelf comprises an opening above the pre-regulating compartment to facilitate fluid communication between the pre-regulating compartment and the thermally insulated beverage compartment.

In another aspect, the invention includes a beverage dispenser comprising a thermal regulant storage area adapted to store a thermal regulant. The beverage dispenser further comprises a thermally insulated beverage compartment that encloses the thermal regulant storage area and is configured to support installation of one or more ready to drink beverage containers for gravity fed beverage dispensing. The ambient temperature in the thermally insulated beverage compartment is regulated through natural convection.

In some embodiments, the beverage dispenser further comprises a pre-regulating compartment below the thermally insulated beverage compartment and adapted to store one or more beverage containers.

In some embodiments, the thermally insulated beverage compartment comprises an opening above the pre-regulating compartment to facilitate fluid communication between the pre-regulating compartment and the thermally insulated beverage compartment.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 2:
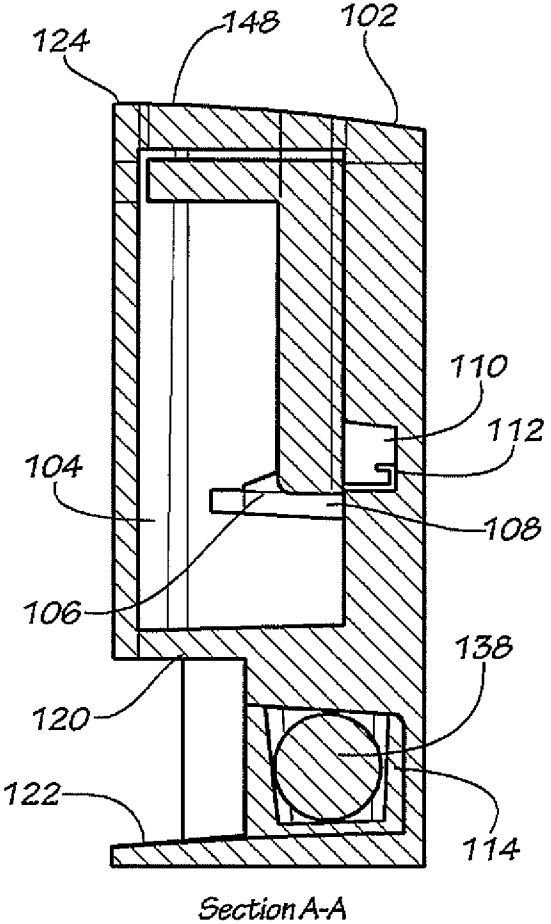
FIG. 2 illustrates a cross-section view of an exemplary beverage dispenser according to the first aspect of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

As used herein, the phrase "pre-mixed beverage" is intended to encompass beverages that are ready to drink and do not require mixing with other ingredients prior to consumption. For example, a 2-liter bottle of COCA-COLA® is a pre-mixed beverage. In contrast, a bag-in-box syrup of COCA-COLA® is not a pre-mixed beverage because the syrup may need to be mixed with a diluent such as carbonated water prior to consumption. Similarly, a container of MINUTE MAID® orange juice is a pre-mixed beverage. In contrast, a MINUTE MAID® concentrate is not a pre-mixed beverage because the concentrate may need to be mixed with a diluent such as water prior to consumption.

As used herein, the phrase "ready to drink" beverage(s) is intended to encompass beverages that are in a consumable state as intended by a beverage maker. For example, while COCA-COLA® syrup may be in a consumable state, The Coca-Cola Company may intend for the COCA-COLA® syrup to be mixed with carbonated water prior to consumption. Similarly, other beverage concentrates, while in a consumable state, may not be intended for consumption as a beverage concentrate alone, but may be intended for consumption as a beverage after mixing with a diluent. Also, a "ready to drink" beverage is intended to encompass beverages that are not mixed from concentrate. For example, fresh squeezed orange juice, brewed tea, water, or other beverages that are not mixed from concentrate may be "ready to drink" beverages.

As used herein, the term "beverage" is intended to encompass both still, or non-carbonated, and sparkling, or carbonated, beverages.

As used herein, the term "removable" is intended to encompass both partially removable components and fully removable components. For example, as described in more detail below in conjunction with FIGS. 5A-5D, the thermal tray is at least partially removable from a stowed position in the beverage dispenser so as to facilitate refilling the thermal tray. Similarly, as described in more detail below in conjunction with FIGS. 9-10, the thermal drawers may be fully removable from the beverage dispenser.

As used herein, the phrase "thermal regulant" is intended to encompass any material that adds or removes heat from a system. For example, ice is a thermal regulant that may be used to cool a system. In contrast, hot water is a thermal regulant that may be used to heat a system.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in addition to the orientation depicted in the figures. For example, if the device in the figures is turned over, elements described as "below" or "beneath" other elements or features would then be oriented "above" the other elements or features.

Referring to FIGS. 1-15, views of an exemplary beverage dispenser according to a first aspect of the disclosure are shown. As described in more detail below, the beverage dispenser according to the first aspect of the disclosure includes a thermally insulated compartment for installing one or more pre-mixed or otherwise ready to drink beverage containers (i.e., beverage containers with beverage contents that are pre-mixed or otherwise ready to drink) in an inverted position to enable thermally regulated, gravity fed, on demand dispensing of the beverage contents therein. The beverage dispenser according to the first aspect of the disclosure further includes a removable thermal tray that is adapted to store a thermal regulant, such as ice, gel packs, or hot water, for example. The thermal tray enables regulating the temperature of the one or more pre-mixed or otherwise ready to drink beverage containers through natural convection based on heat added or removed from the thermally regulated compartment by one or more thermal regulants carried within the thermal tray. The beverage dispenser according to the first aspect of the disclosure may further include a pre-regulating storage compartment that is adapted to store one or more additional beverage containers. The pre-regulating storage compartment may use waste heat from the thermal tray to begin regulating the temperature of the one or more pre-mixed or otherwise ready to drink beverage containers stored therein. These and more features of the exemplary beverage dispenser according to the first aspect of the disclosure are described in detail below, wherein like reference numerals represent like parts.

Figure 1:
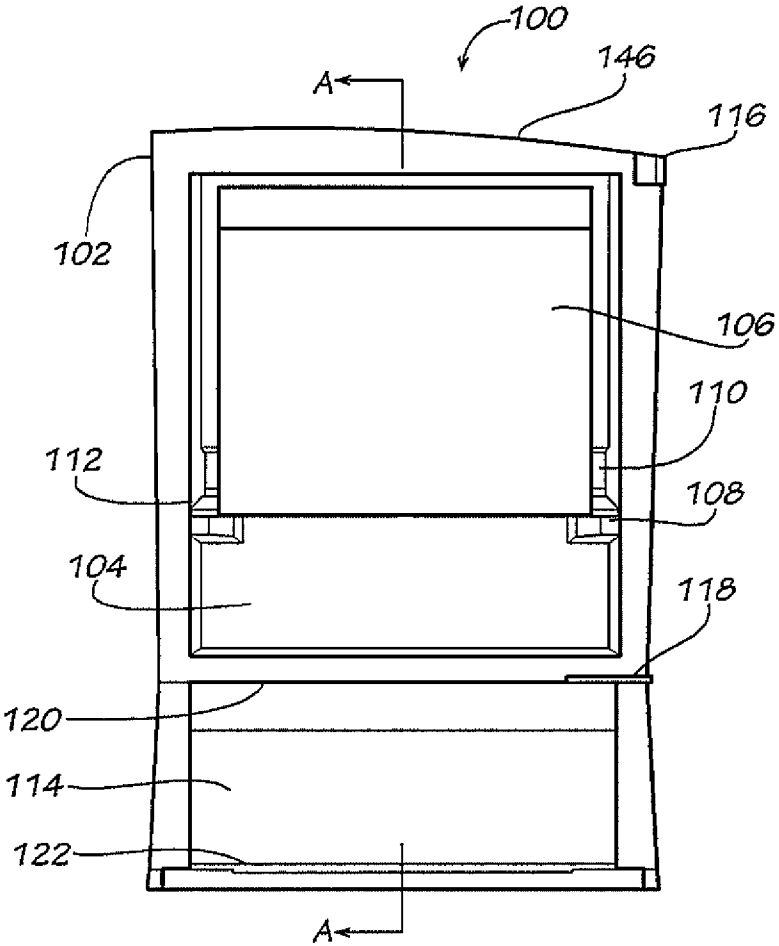
FIG. 1 illustrates a front view of an exemplary beverage dispenser according to a first aspect of the disclosure.

Referring to FIG. 1, a front view of an exemplary beverage dispenser 100 according to the first aspect of the disclosure is shown. The beverage dispenser 100 enables on demand and gravity fed dispensing of pre-mixed or otherwise ready to drink beverages that are thermally regulated through natural convection. The beverage dispenser 100 is illustrated in FIG. 1 with the front door 124 removed so as to show the interior features. The beverage dispenser 100 includes a thermally insulating base 102 that, together with the front door 124, defines a thermally insulated or thermally regulated beverage compartment 104. The beverage compartment 104 may alternately be referred to as a beverage enclosure. FIG. 2 shows additional detail through a cross-section view of the beverage dispenser 100 about the line A-A in FIG. 1. The thermally regulated beverage compartment 104 regulates the temperature of one or more pre-mixed or otherwise ready to drink beverage containers (not shown) installed therein. In some embodiments three beverage containers may be installed in the beverage compartment 104, though installation of more or less beverage containers within the beverage compartment is contemplated by this disclosure. The beverage containers may be installed adjacent to one another in a line, along an arc, or in any other pattern within the beverage compartment 104.

The base 102 may be formed by an exterior shell encasing an insulating material. For example, the exterior shell may be made of a plastic, metal, or ceramic material, though in some embodiments of the disclosure, a plastic shell is used for its light weight and durability. The insulating material may be insulating foam, insulating fiber, or other such material, though in some embodiments of the disclosure, insulating foam is used for its light weight and insulation properties. Alternatively, the base 102 may be integrally formed from a single insulating material. In some embodiments of the disclosure the exterior shell is made of plastic and the insulating material is made of a foam material so as to improve the portability of the beverage dispenser 100.

The temperature is regulated within the beverage compartment 104 through natural convection based on heat added or removed by one or more thermal regulants carried or stored within a removable thermal tray 106. The thermal tray 106 may be considered a thermal regulant storage area. For example, in order to cool the beverage compartment 104, a thermal regulant such as ice or one or more re-freezable packs may be added to the thermal tray 106. Similarly, in order to heat the beverage compartment 104, a thermal regulant such as hot water or coals may be added to the thermal tray 106. One of ordinary skill in the art will readily recognize that in natural convection, fluid flow (e.g., cooled or heated air flow within the beverage compartment 104) is not generated by an external source such as a pump, fan, or other such mechanical or electro-mechanical device. The thermal tray 106 may be made of any thermally conductive material such as a metal, plastic, or a ceramic, though in some embodiments the thermal regulant may be made of aluminum. While shown in FIG. 1 as a solid tray, the thermal tray 106 may include perforations to more readily enable heat transfer between the thermal regulant and the beverage compartment 104.

To facilitate reloading of the thermal tray 106, the beverage dispenser 100 includes a support shelf 108, a cavity 110, and a cam 112. As shown in FIGS. 5A-5D and described in greater detail below, the support shelf 108 supports the thermal tray 106 while reloading thermal regulant. The cavity 110 provides a space into which a rear portion of the thermal tray 106 may fit. In some embodiments, the cavity 110 may be sized to frictionally lock the thermal tray 106 in place. Alternatively, the thermal tray 106 may freely enter and exit from within the cavity 110. The cam 112 provides a path over which a wheel, roller, or axel of the thermal tray 106 may roll.

The beverage dispenser 100 may optionally include a pre-regulating drawer 114. The pre-regulating drawer 114 is a storage compartment adapted to store one or more pre-mixed or otherwise ready to drink beverage containers 138. The pre-regulating drawer 114 may use waste heat from the thermal tray 106 to begin regulating the temperature of the one or more pre-mixed or otherwise ready to drink beverage containers 138 stored therein. For example, ice melt water may be collected in pre-regulating drawer 114 so as to pre-cool the beverage container 138 prior to installation in the beverage compartment 104. The pre-regulating drawer 114 may also be directly loaded with thermal regulant. For example, ice may be directly loaded into the pre-regulating drawer 114 to further accelerate pre-cooling of the beverage container 138.

The beverage dispenser 100 includes an upper door mount 116 and a lower door mount 118 to facilitate attaching the front door 124 to the base 102. The front door 124 may rotate about an axis between the upper door mount 116 and the lower door mount 118. While the upper door mount 116 and the lower door mount 118 are shown in FIG. 1 on the right side of the beverage dispenser 100, the door mounts 116, 118 may alternatively be placed on the left side of the beverage dispenser 100. In such a case, the front door 124 would open from right to left as opposed to left to right as shown in the figures.

The beverage dispenser 100 further includes a dispensing shelf 120. The upper side of the dispensing shelf 120 supports beverage containers installed in the beverage compartment 104. The lower side of the dispensing shelf 120 supports a dispenser assembly 168 to facilitate dispensing of beverage contents from the beverage containers installed in the beverage compartment 104. Various embodiments of the dispenser assembly 168 are discussed in detail below. The dispensing shelf 120 may be integrally formed with the base 102 of the beverage dispenser or the dispensing shelf 120 may be separately formed and attached to the base 102, as shown in FIGS. 3A-3C.

The beverage dispenser 100 includes a cup rest 122 positioned below the dispensing shelf 120. The cup rest 122 provides a stable planar surface upon which a customer's cup or beverage container of choice may securely rest while dispensing a beverage. The cup rest 122 may include a splash mat (shown in FIG. 3A) and/or a drain plate (not shown).

The beverage dispenser 100 may also include a slanted top surface that follows a first contour 146 when viewed from the front. The slanted top surface follows a second contour 148 when viewed from the side as best seen in the cross-section view of FIG. 2. The slanted top surface prevents merchants from stacking off-brand, distracting, or unattractive merchandise or storage containers on top of the beverage container 100.

Figure 3A:
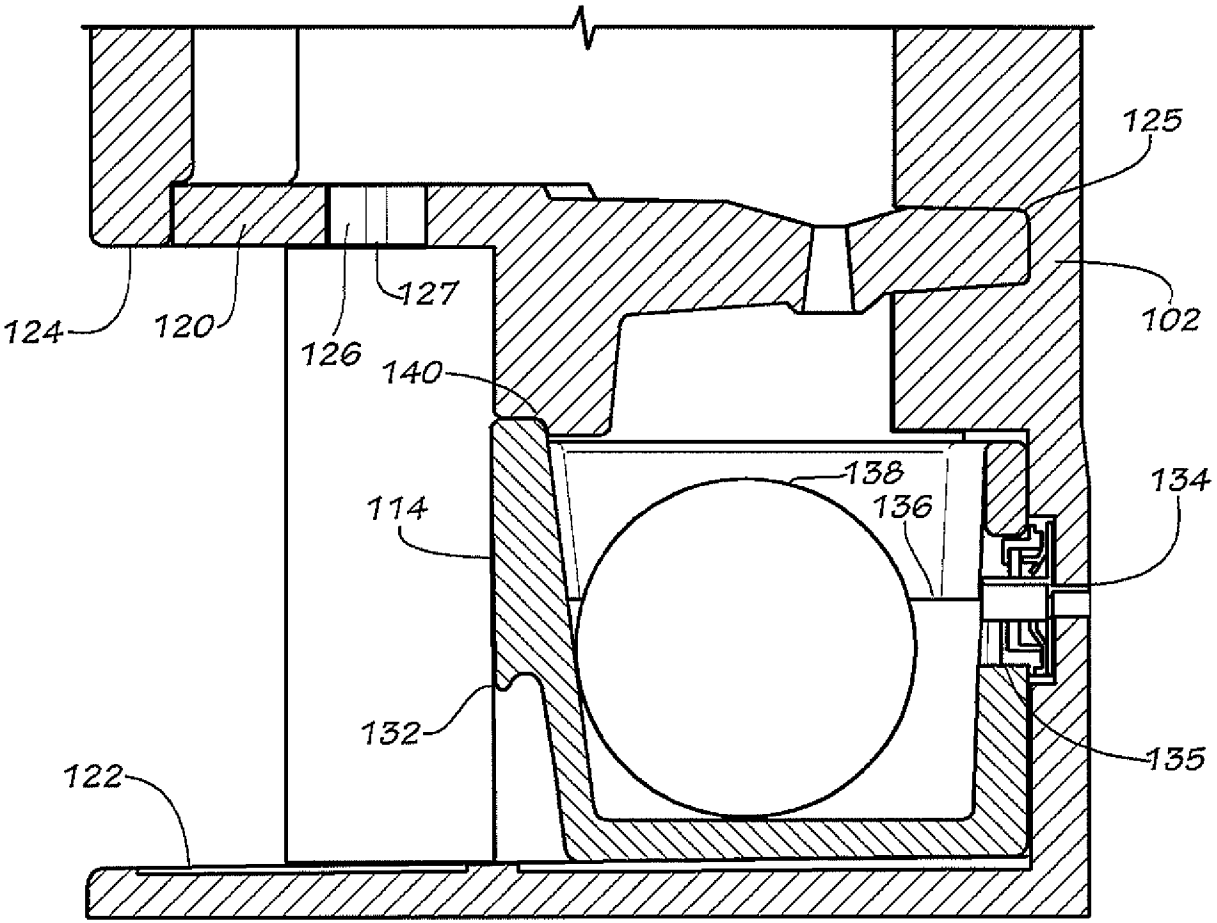
FIG. 3A illustrates a cross-section view of a bottom portion of an exemplary beverage dispenser according to the first aspect of the disclosure.
Figure 3B:
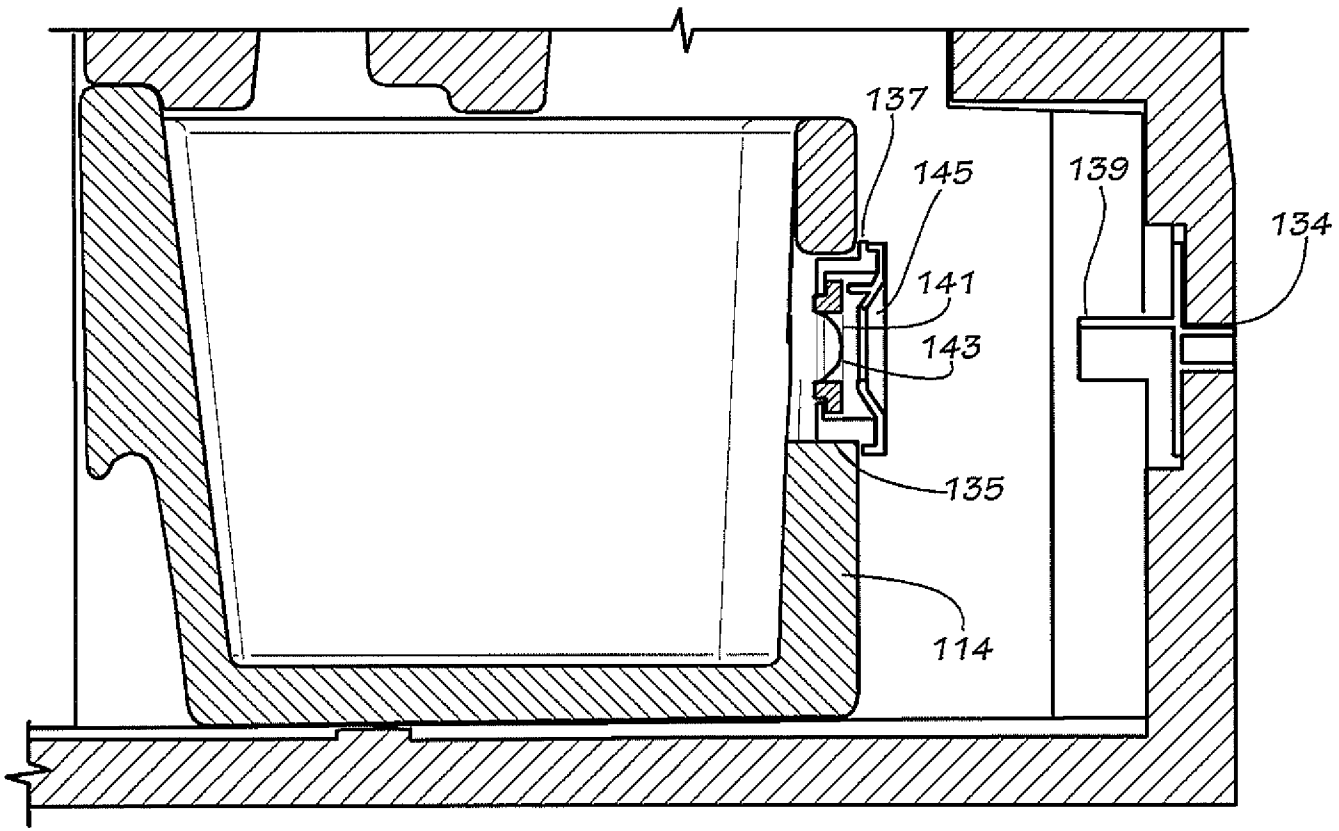
FIG. 3B illustrates a cross-section view of an exemplary beverage dispenser according to the first aspect of the disclosure with one-way valve of a pre-regulating drawer in a closed position.
Figure 3C:
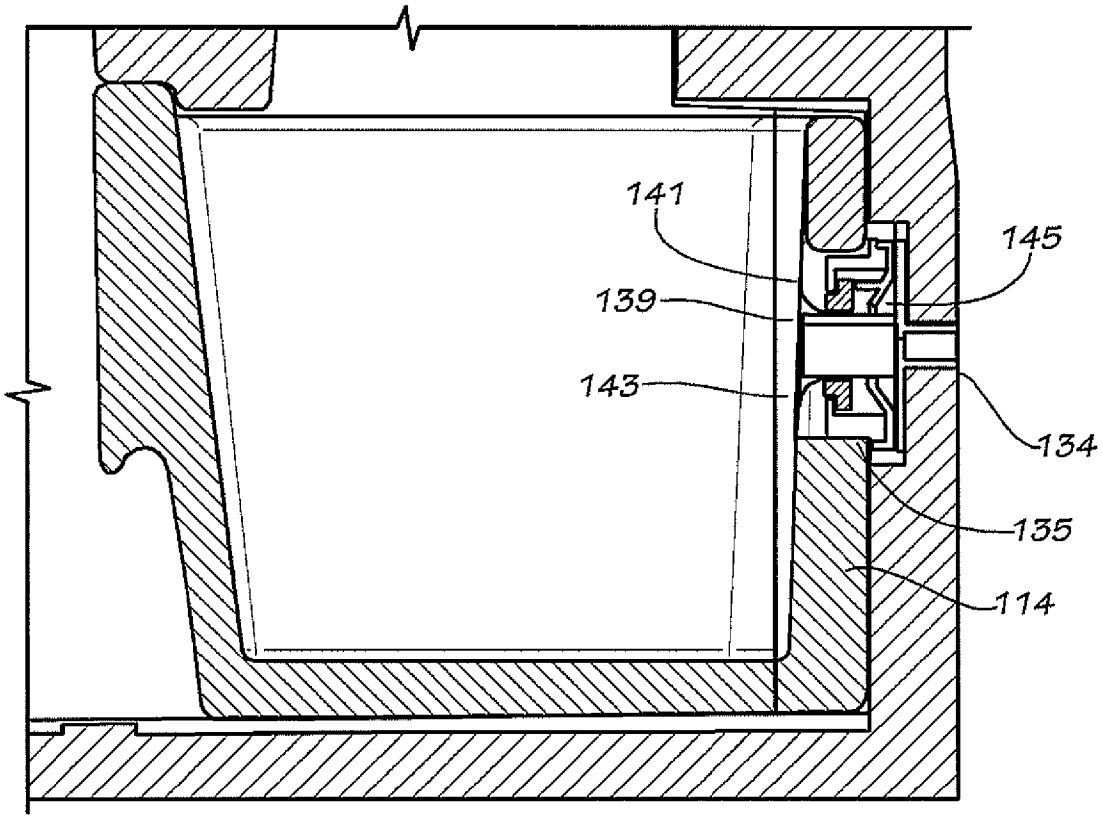
FIG. 3C illustrates a cross-section view of an exemplary beverage dispenser according to the first aspect of the disclosure with one-way valve of a pre-regulating drawer in an open position.

Referring to FIG. 3A, a cross-section view of a bottom portion of an exemplary beverage dispenser according to the first aspect of the disclosure is shown. As mentioned above, the dispensing shelf 120 may be separately formed and attached to the base 102, such as through engagement with slot 125. The slot 125 may extend the length of the interior back wall of the base 102 or may additionally extend along one or both of the interior side walls of the base 102. To enable installation of the dispenser assembly 168 and a container mount 170, discussed in more detail below, the dispensing shelf 120 includes a beverage aperture 126 for each beverage container to be installed within the beverage compartment 104. The beverage aperture 126 may optionally include a groove 127 to accept a portion of the dispenser assembly 168 or the container mount 170. In some embodiments the groove 127 may be a keying or alignment groove that ensures that the dispenser assembly 168 is installed facing in the correct direction and prevents rotation of the dispenser assembly 168 within the beverage aperture 126. While the groove 127 is only shown on one side of the aperture 126 in the cross-section view of FIG. 3A, the groove 127 may also be present on the opposite side of the aperture 126.

A back portion of the dispensing shelf 120 may include an aperture 130 to enable fluid communication between the beverage compartment 104 and the pre-regulating drawer 114. The aperture 130 may enable convective heat transfer between the beverage compartment 104 and the pre-regulating drawer 114. For example, while cooling a beverage container in the beverage compartment 104, the pre-regulating drawer 114 may facilitate cooling of the one or more beverage containers 138 stored therein through natural convection enabled by fluid communication through the aperture 130. Similarly, one or more beverage containers 138 stored in the pre-regulating drawer 114 may be warmed through natural convection enabled by fluid communication through the aperture 130.

Additionally, when ice is used as a thermal regulant in the thermal tray 106, the fluid communication provided by the aperture 130 enables melt water to drain into and collect in the pre-regulating drawer 114. By collecting the ice melt in the pre-regulating drawer 114, the one or more beverage containers 138 stored therein may begin to be cooled. Similarly, other fluids that may be contained within the thermal tray 106 or that may be discharged from the thermal tray 106 may be communicated to the pre-regulating drawer 114 via the aperture 130.

To encourage fluid flow through the aperture 130, the back portion of the dispensing shelf 120 may have a sloped surface 128. While the sloped surface 128 is shown in FIG. 3A to have a "V" shape, the sloped surface 128 may also form a cone or funnel shape about the aperture 130. While only one aperture 130 is shown in FIG. 3A, the dispensing shelf 120 may include a plurality of the aperture 130 along the length and/or width of the dispensing shelf 120 above the pre-regulating drawer 114. In some embodiments, openings other than the aperture 130 may provide fluid communication between the beverage compartment 104 and the pre-regulating drawer 114. For example, the aperture 130 may be replaced with a slot, a grill, or other open forms without departing from the spirit or scope of the disclosure.

In some embodiments, the pre-regulating drawer 114 may include an integrally formed grip 132 to facilitate opening and closing of the pre-regulating drawer 114. Alternatively, the pre-regulating drawer 114 may have a handle, knob, or other such structure affixed to the outer surface of the pre-regulating drawer 114 to facilitate opening and closing.

To improve insulating properties of the beverage dispenser 100, the front door 124 and the pre-regulating drawer 114 may have overlapping geometries with the base 102 and/or the dispensing shelf 120 (when distinct from the base 102). Such overlapping geometries help to trap air inside the beverage dispenser 100 and provide surfaces on which seals may be affixed or embedded to further reduce air flow. Specifically, at the point of engagement between the pre-regulating drawer 114 and the dispensing shelf 120, the dispensing shelf 120 may include a lip 140. As shown in FIG. 3A, the lip 140 may extend below the top surface of the pre-regulating drawer. Similarly, the front door 124 may include a surface 142 that extends beyond and overlaps with the front surface of the dispensing shelf 120 and the base 102 with which the front door 124 contacts in a closed position. In some embodiments, the overlapping geometry of the lip 140 may, by itself, act as an insulating seal between the front door 124 and the base 102 and maintain the front door 124 in a closed position. Accordingly, the front door 124 may avoid the use of an attachment mechanism to maintain the front door 124 in a closed position.

In some embodiments, the front door 124 and/or the base 102 may include corresponding attachment mechanisms for positively closing the front door 124. For example, front door 124 and the base 102 may each include one or more magnets for positively closing the front door 124. Alternatively, the front door 124 may include a latch and the base 102 may include a latch point for positively closing the front door 124. Other attachment mechanisms would be readily apparent to those of ordinary skill in the art and may be used to positively close the front door 124.

The base 102 may include a rear aperture 134 at a location corresponding to a rear aperture 135 of the pre-regulating drawer 114. The rear aperture 135 of the pre-regulating drawer 114 may be at an intermediate position along a rear surface of the pre-regulating drawer 114. When installed in the base 102, the rear aperture 135 of the pre-regulating drawer 114 is aligned with and in fluid communication with the rear aperture 134 of the base so as to enable draining of excess fluid from the pre-regulating drawer 114. In some embodiments, a drain hose may be attached to the rear aperture 134 of the base 102 to carry the excess fluid away from the beverage dispenser 100. The fluid communication between the rear apertures 134, 135 maintains the fluid level 136 of the pre-regulating drawer 114 at a position below the top of the pre-regulating drawer so as to prevent fluid overflow of the pre-regulating drawer 114. In some embodiments, one or more seals may be present about the rear aperture 134 of the base and/or the rear aperture 135 of the pre-regulating drawer 114 so as to prevent leakage of fluid between the back surface of the pre-regulating drawer 114 and the lower interior rear wall of the base 102.

Referring to FIGS. 3B and 3C, the rear aperture 135 of the pre-regulating drawer may include a one-way valve 137 to prevent fluid leakage through the rear aperture 135 when installing or removing the pre-regulating drawer 114. As shown in FIG. 3B, the one-way valve 137 is in a closed position. The one-way valve 137 may include a top member 141 and a bottom member 143 that are biased to engage with each other and fluidly seal or otherwise reduce fluid flow through the rear aperture 135. The top and bottom members 141, 143 may be formed of an elastomeric material. Alternatively, the top and bottom members 141, 143 may be rigid members that are spring-biased to engage with one another. The base 102 may include a hollow protrusion 139 installed in the rear aperture 134 for engaging the one-way valve 137. The hollow protrusion 139 may interfere with the top and bottom members 141, 143 to thereby open the one-way valve 137. As shown in FIG. 3C, the one-way valve is in an open position. The adapter 139 has been pushed through the one-way valve 137 such that the top and bottom members 141, 143 are no longer engaged with one another. Therefore, fluid may flow from the pre-regulating drawer 114, through the hollow protrusion 139, and ultimately out the rear aperture 134. The one-way valve 137 may include a ramped lead-in 145 to facilitate pushing the pre-regulating drawer 114 into the beverage dispenser 100 without requiring alignment effort by the user. In other words, the ramped lead in 145 enables easy engagement of the hollow protrusion 139 with the one-way valve 137.

Figure 4:
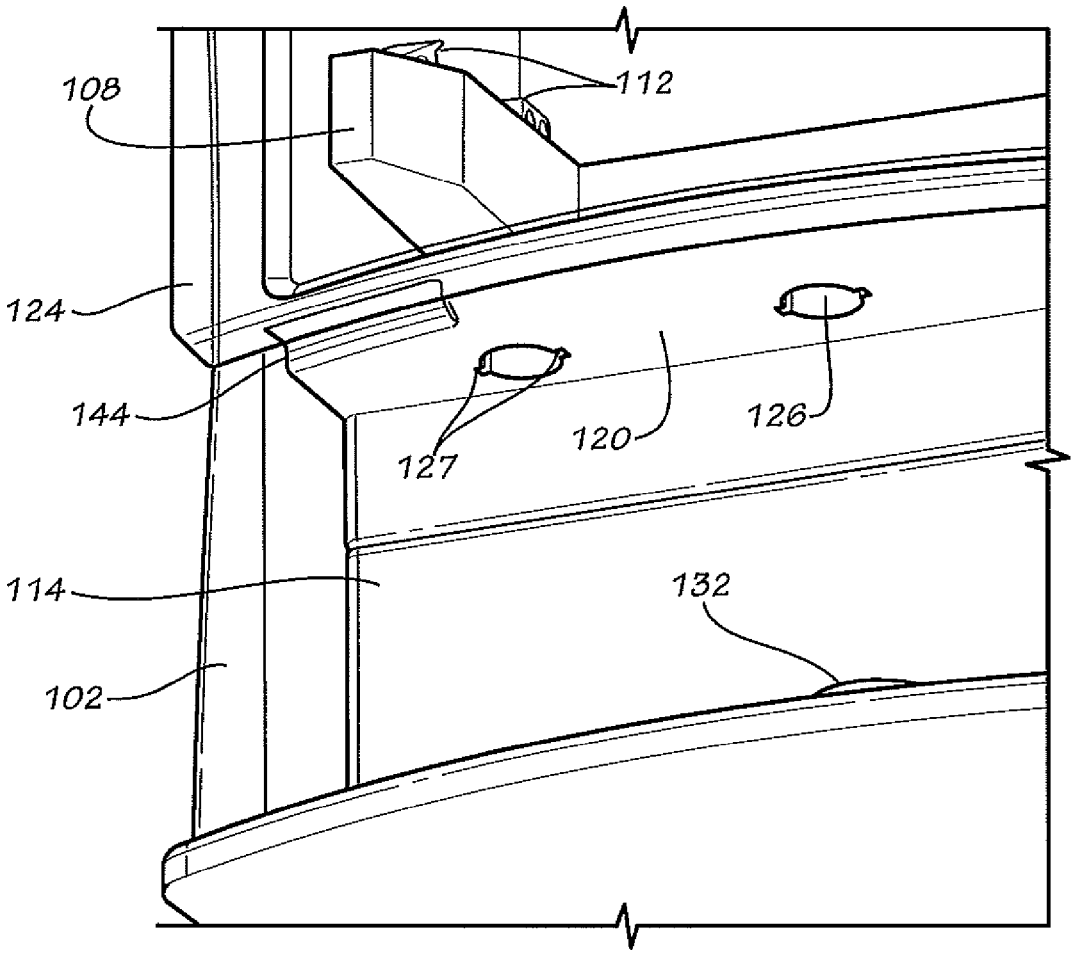
FIG. 4 illustrates a perspective view of a lower portion of an exemplary beverage dispenser according to the first aspect of the disclosure.

Referring to FIG. 4, a perspective view of a lower portion of an exemplary beverage dispenser according to the first aspect of the disclosure is shown. As shown in FIG. 4, the lower side of the dispensing shelf 120 may include a recessed area 144 to facilitate easier opening of the front door 124. The recessed area 144 is on a side of the dispensing shelf 120 opposite the upper and lower door mounts 116, 118. Alternatively, the front door 124 may itself include a recessed area 144 on the lower surface of the front door 124.

Figure 5D:
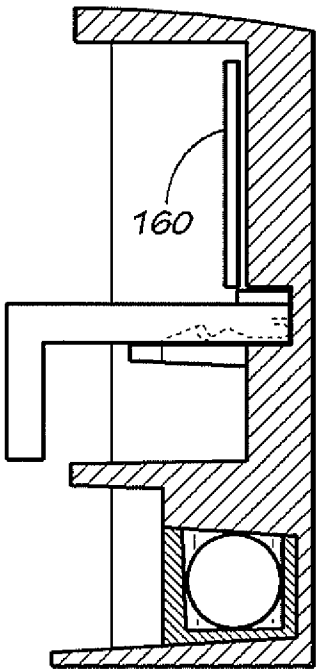
FIG. 5D illustrates a side view of an exemplary beverage dispenser according to the first aspect of the disclosure with the thermal tray in a lower locked position with the lid opened.
Figure 5C:
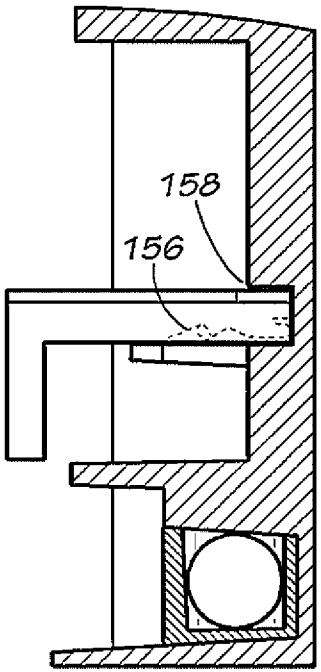
FIG. 5C illustrates a side view of an exemplary beverage dispenser according to the first aspect of the disclosure with the thermal tray in a lower locked position.
Figure 5B:
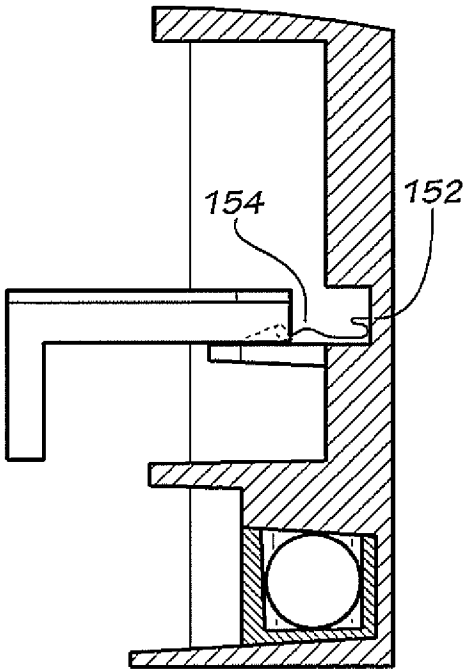
FIG. 5B illustrates a side view of an exemplary beverage dispenser according to the first aspect of the disclosure with the thermal tray in a lowered position.
Figure 5A:
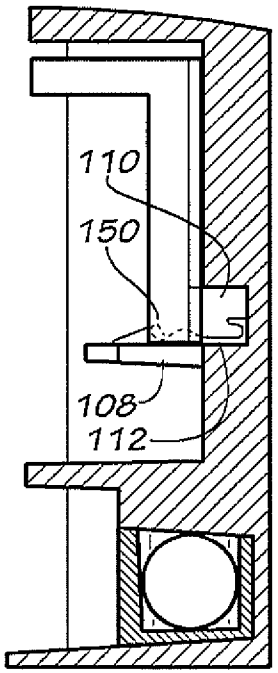
FIG. 5A illustrates a side view of an exemplary beverage dispenser according to the first aspect of the disclosure with a thermal tray in a stowed position.

With reference to FIGS. 5A-5D, the operation of and the various positions of the thermal tray 106 are discussed. FIG. 5A shows a side view of an exemplary beverage dispenser according to the first aspect of the disclosure with the thermal tray 106 in a stowed position. As shown in FIG. 5A, the thermal tray 106 includes a roller 150 that provides an axis of rotation of the thermal tray 106. In the stowed position, the roller 150 is engaged with a front catch 156 of the cam 112.

FIG. 5B shows a side view of an exemplary beverage dispenser according to the first aspect of the disclosure with the thermal tray 106 in a lowered position. The thermal tray 106 may be lowered into the lowered position by rotating the thermal tray 106 about the roller 150. The support shelf 108 partially supports the thermal tray 106 in the lowered position.

FIG. 5C shows a side view of an exemplary beverage dispenser according to the first aspect of the disclosure with the thermal tray 106 in a lower locked position. In the lower locked position, a rear portion of the thermal tray 106 fits within the cavity 110 and the support shelf 108 supports the thermal tray 106. In the lower locked position, the roller 150 is engaged with a rear catch 152 of the cam 112. The thermal tray 106 may be locked into the lower locked position by pushing back on the thermal tray 106 in the lowered position. As best seen in FIG. 5B, the cam 112 includes a ridge 154 over which the roller 150 travels in order to alternately engage the front catch 156 and the rear catch 152. Therefore, the ridge 154 aids in maintaining the thermal tray 106 in either the lower locked position or the lowered position. To position the thermal tray 106 into the lower locked position, enough force must be applied to the thermal tray 106 for the roller 150 to travel over the ridge 154 and subsequently engage with the rear catch 152. In some embodiments, the front catch 156 and the rear catch 152 may lock the roller 150 in the respective catch, such as through friction, a spring, or other such mechanical engagement.

FIG. 5D shows a side view of an exemplary beverage dispenser according to the first aspect of the disclosure with the thermal tray 106 in a lower locked position with a lid 160 opened. The lid 160 may be connected to the thermal tray 106 with a hinge 158, shown in FIG. 5C, to enable opening and closing of the lid. In the lower locked position with the lid 160 opened additional thermal regulant (e.g., ice or hot water) may be loaded into the thermal tray 106. During loading, the support shelf 108 and the cavity 110 stabilize the thermal tray 106 and support the additional weight of the thermal regulant added to the thermal tray 106. Once the thermal tray 106 is reloaded, the lid 160 may be closed and the procedure reversed for moving the thermal tray 106 into the stowed position again.

As shown in FIGS. 5B-5D, the thermal tray 106 may be at least partially removed from the beverage dispenser 100 and as such the thermal tray 106 may be considered partially removable. As illustrated, the cam 112 is open between the front catch 156 and the rear catch 152. Therefore, it is possible for the thermal tray 106 to be moved to an intermediate position between the front catch 156 and the rear catch 152 and be lifted off of the cam 112. Accordingly, the thermal tray 106 may also be fully removed from the beverage dispenser 100 for cleaning and maintenance and as such the thermal tray 106 may be considered fully removable. In some embodiments, the cam 112 may form a closed figure through which roller 150 may travel so as to prevent the thermal tray 106 from being fully removed from the beverage dispenser 100.

Figure 6:
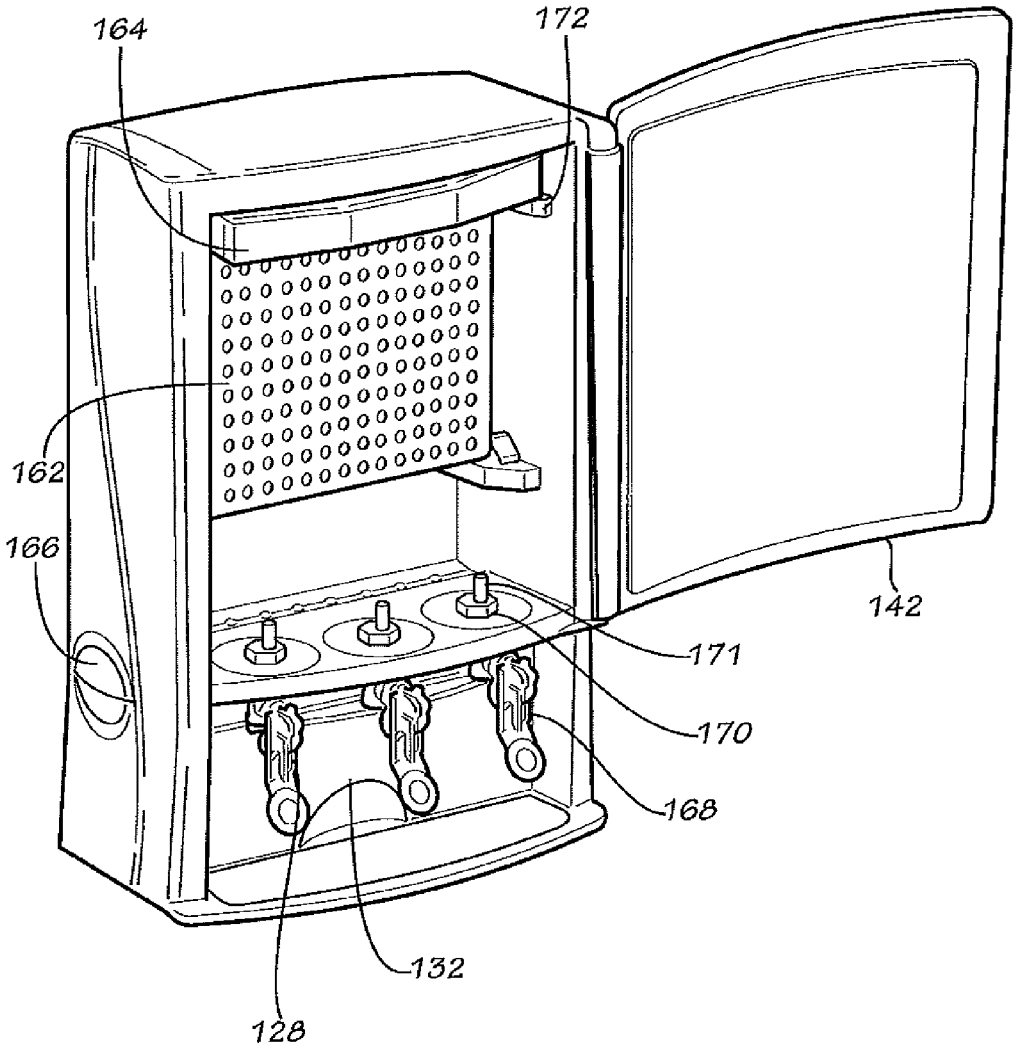
FIG. 6 illustrates a perspective view of an exemplary beverage dispenser according to the first aspect of the disclosure with the thermal tray in a stowed position.

Referring to FIG. 6, a perspective view of an exemplary beverage dispenser according to the first aspect of the disclosure is shown with the thermal tray in a stowed position. As shown in FIG. 6, the thermal tray 106 may be perforated with a plurality of perforations 162. The perforations aid in heat transfer between the beverage compartment 104 and the thermal regulant carried in the thermal tray 106. Additionally, when ice is used, the perforations 162 enable the ice melt to drain out of the thermal tray 106 for collection in the pre-regulating drawer 114, as discussed above.

The thermal tray 106 may generally take the shape of an inverted "L" in the stowed position. The thermal tray 106 may have a first storage area portion located behind beverage containers installed within the beverage compartment 104 and a second storage area portion located above beverage containers installed within the beverage compartment 104. In some embodiments, the second storage area may have a sloped surface 164 on the front end to match the contoured front edge of the beverage dispenser 100. As illustrated, the first storage area portion of the thermal tray 106 is longer than the second storage area portion. However, the first and second storage area portions of the thermal tray 106 may be of equal length or the second storage area may be longer than the first storage area.

The thermal tray 106 may take any desired shape within the beverage dispenser so long as the thermal tray 106 does not obstruct the installation of beverage containers within the beverage compartment 104 and the thermal tray 106 is at least partially removable to facilitate reloading. For example, the thermal tray 106 may simply take a vertical square shape or other closed shape (e.g., polygon, ellipse, etc.) such that there is no second storage area above beverage containers installed within the beverage compartment 104. As another example, the thermal tray 106 may take a horizontal square shape or other closed shape such that there is no first storage area behind beverage containers installed within the beverage compartment. It is further contemplated that the thermal tray 106 may have more complex geometries such as a horizontal wave or other such shape to contour around or otherwise complement the shape of the beverage containers stored within the beverage compartment 104.

In some embodiments, the beverage dispenser 100 may have an integrally formed carrying handle 166. While only depicted on the left side of the beverage dispenser 100, a corresponding carrying handle 166 may also be present on the right side of the beverage dispenser 100. In some embodiments, the carrying handle 166 is not integrally formed with the base 102, but instead may be later attached to the base 102.

As shown in FIG. 6, the beverage dispenser 100, and more particularly the dispensing shelf 120, supports a dispenser assembly 168 and a container mount 170. Briefly, the container mount 170 facilitates the installation of a pre-mixed or otherwise ready to drink beverage container in an inverted position within the beverage compartment 104. In some embodiments the container mount 170 may include a container adapter 220 and a container support 222 (shown in FIG. 14). The container support 222 may be affixed to the dispensing shelf 120 with one or more connectors 224. The container adapter 220 may be affixed to a beverage container, such as a bottle, prior to installation or in conjunction with installation in the beverage compartment 104. The container adapter 220 may include a one-way valve vent 171 that is configured to vent air into the beverage container as beverage contents are dispensed. The container adapter 220 may also include a dispenser tube 184 that dispenses beverage contents through the dispenser assembly 168. The dispenser tube 184 may be offset or coaxially formed with the vent 171. The container adapter 220 may further include snaps or other attachment mechanisms for attaching to the container support 222. In some embodiments, the container mount 170 may be constructed as described in Chinese Patent Application 201110175521.7 (Atty. Dock. Num. CP1110569/ME) filed on Jun. 23, 2011 to Quande Gui, et al. and Chinese Patent Application 201120220882.4 (Atty. Dock. Num. CP2110569/ME) filed on Jun. 23, 2011 to Quande Gui, et al., both of which are incorporated herein by reference in their entirety.

Figure 7:
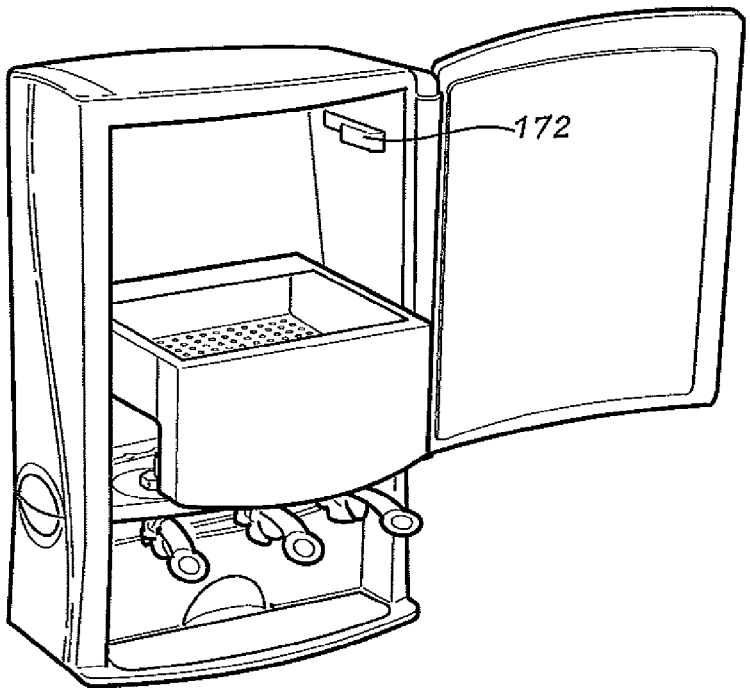
FIG. 7 illustrates a perspective view of an exemplary beverage dispenser according to the first aspect of the disclosure with the thermal tray in a lower locked position with the lid opened.

Referring to FIG. 7, a perspective view of an exemplary beverage dispenser according to the first aspect of the disclosure is shown with the thermal tray 106 in a lower locked position with the lid 160 opened. In the stowed position, the thermal tray 106 may be secured by a latch 172 as shown in FIG. 6. The latch 172 may prevent the thermal tray 106 from falling forward onto beverage containers installed within the beverage compartment 104 or falling forward when the front door 124 is opened and there are no beverage containers installed within the beverage compartment 104. In some embodiments the latch 172 may take the form of a leaf spring as shown in FIG. 7. Alternatively, when the thermal tray is made out of a metal, one or more magnets may be installed on the rear interior wall on the base 102 so as to magnetically latch the thermal tray 106 in the stowed position. It is contemplated that any mechanical or magnetic latch mechanism known to those of ordinary skill in the art may be used to secure the thermal tray 106 to the base 102 in the stowed position.

Figure 8:
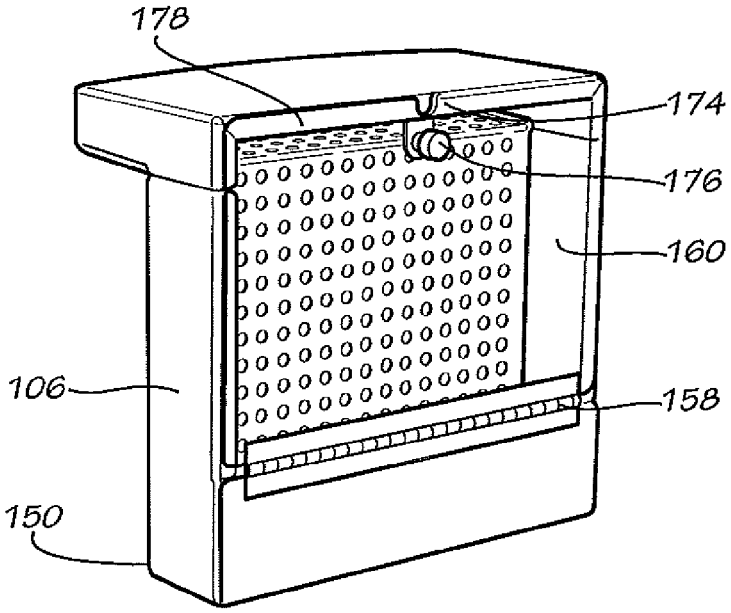
FIG. 8 illustrates a perspective view of the thermal tray.

Referring to FIG. 8, a perspective view of the thermal tray 106 is shown. The lid 160 of the thermal tray 106 may include a slot 174 that is sized and shaped to allow engagement with a person's finger to facilitate lifting of the lid 160. The lid 160 may also include a lock 176 that securely attaches the lid 160 to the thermal tray 106. The lock 176 ensures that after reloading the thermal tray 106 with thermal regulant, the lid 160 does not open while placing the thermal tray 106 in the stowed position. As shown in FIG. 8, the lock 176 may comprise a knob attached to an elliptical member. Upon rotating the knob such that the elliptical member is vertically oriented, the elliptical member may slide under a lip 178 of the thermal tray 106. It is contemplated that any mechanical or magnetic lock mechanism known to those of ordinary skill in the art may be used to secure the lid 160 to the thermal tray 106.

With reference to FIGS. 9-12, because the thermal tray 106 described above requires removal of any beverage containers installed within the beverage compartment 104 prior to reloading the thermal tray 106, mid-day reloading of the thermal tray 106 may be time consuming. Accordingly, various alternative thermal regulant storage compartments are contemplated.

Figure 9:
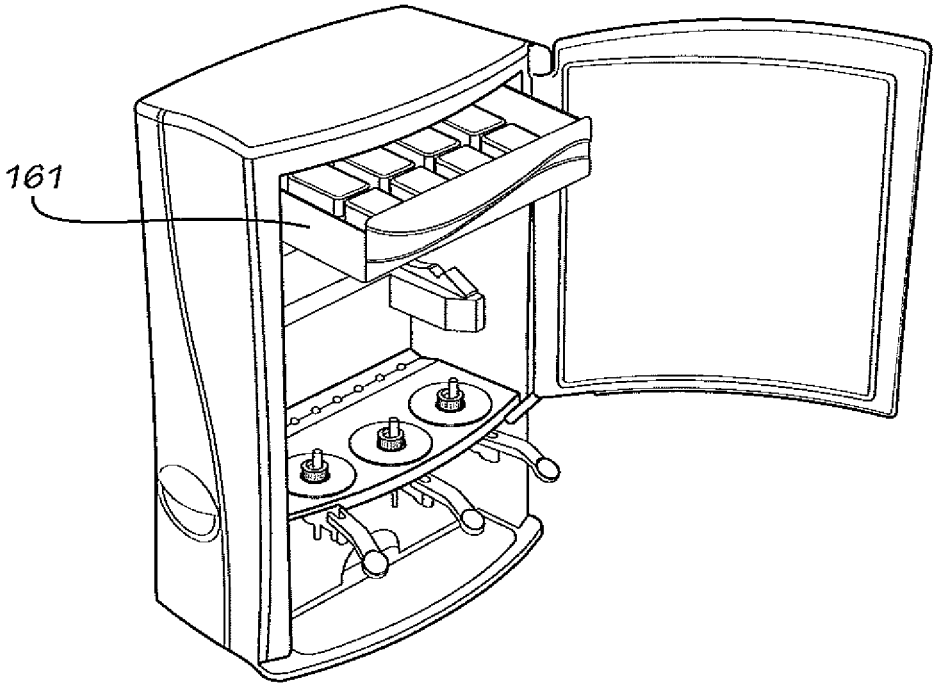
FIG. 9 illustrates a perspective view of an exemplary beverage dispenser according to the first aspect of the disclosure with a thermal drawer.

Referring to FIG. 9, a perspective view of an exemplary beverage dispenser according to the first aspect of the disclosure is shown with a thermal drawer 161. The thermal drawer 161 may be installed in the top portion of the beverage compartment 104 above any beverage containers installed therein. A plurality of re-freezable packs is shown in FIG. 9 to be stored within the thermal drawer 161, though any thermal regulant may be stored therein. Because the thermal drawer 161 is above where the beverage containers are installed within the beverage compartment 104, the thermal drawer 161 may be removed and replaced while beverage containers remain installed in the beverage compartment 104. Accordingly, the thermal drawer 161 may be reloaded without removing any beverage containers installed within the beverage compartment 104. The thermal drawer 161 may be made of thermally conductive material and may or may not have perforations on a bottom surface of the thermal drawer.

Figure 10:
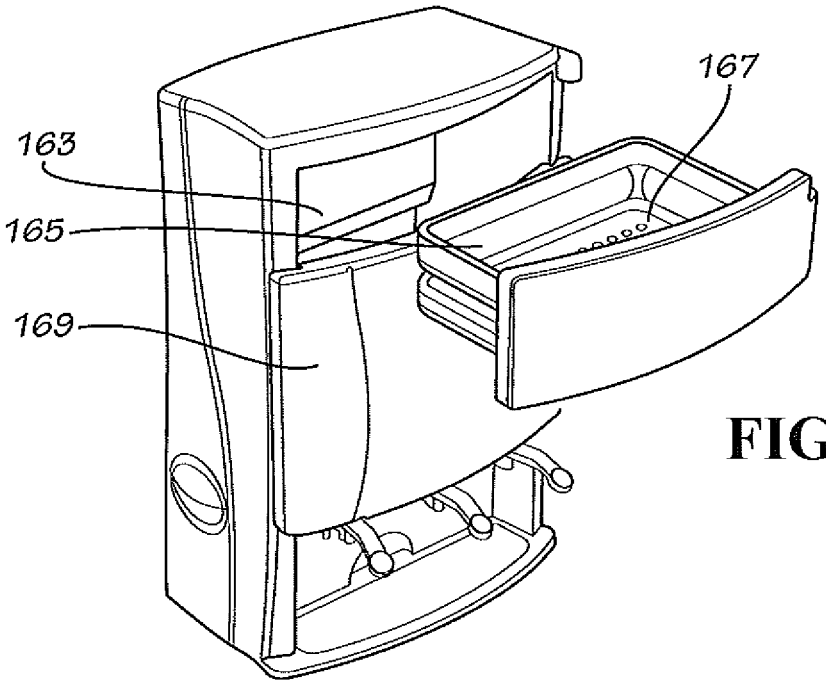
FIG. 10 illustrates a perspective view of an exemplary beverage dispenser according to the first aspect of the disclosure with a reduced front door height and a separate thermal drawer.

Referring to FIG. 10, a perspective view of an exemplary beverage dispenser according to the first aspect of the disclosure is shown with a reduced front door height and a separate thermal drawer. While the thermal drawer 161 enables reloading without removing any beverage containers installed within the beverage compartment 104, the front door 124 is opened to remove and replace the thermal drawer 161. Accordingly, the temperature within the beverage compartment 104 may require time to be re-regulated to a desired temperature.

Rather than requiring that the front door 124 be opened for reloading of the thermal drawer 161, the beverage dispenser 100 may include a thermal drawer 165 that is separate from the front door 169. The thermal drawer 165 may be inserted into a storage area 163 above where beverage containers are installed within the beverage compartment 104. Because the thermal drawer 165 is separate from the front door 169 the front face of the thermal drawer 165 may form part of the exterior of the beverage dispenser 100. Similar to the embodiments described above, the thermal drawer 165 may include perforations 167 to facilitate convective heat transfer as well as to enable draining of fluids from the thermal drawer 165, such as when using ice as a thermal regulant. In some embodiments, the thermal drawer 165 may not have any perforations 167. Also, in sonic embodiments, the base of the thermal drawer may be made of a thermally conductive material, such as aluminum. In contrast, the front face of the thermal drawer 165 may be made of a thermally insulating material.

With the thermal drawer forming part of the exterior of the beverage dispenser 100, the front door 169 may be reduced in height or otherwise not fully span the entire height of the beverage compartment 104. In other words, the top of the front door 169 may be at an intermediary position along the height of the beverage compartment 104. For example, the front door 169 may be at about ⅔ the height of the beverage compartment 104.

The thermal drawers 161, 165 may be partially removable or fully removable from the beverage dispenser 100. For example, a catch on the thermal drawers 161, 165 or the base 102 or both may prevent the thermal drawers 161, 165 from being fully removable. Alternatively, the thermal drawers 161, 165 may be fully removable from the beverage dispenser 100.

Figure 11:
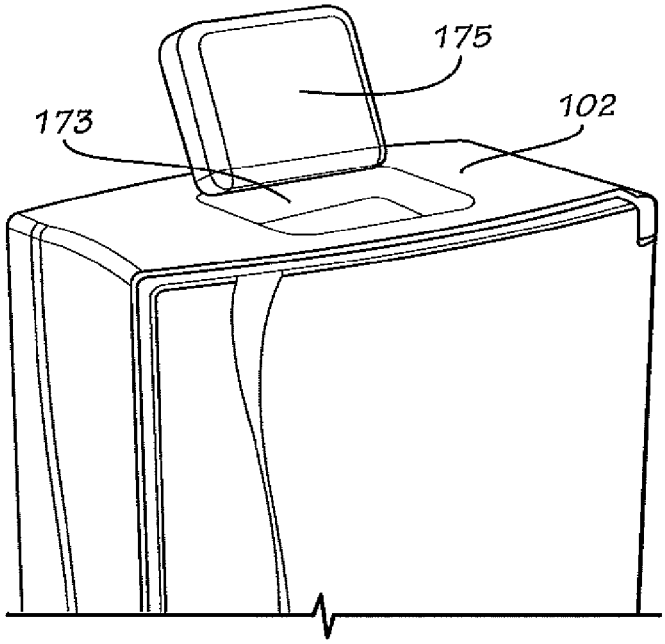
FIG. 11 illustrates a perspective view of an exemplary beverage dispenser according to the first aspect of the disclosure with a top access door.

Referring to FIG. 11, a perspective view of an exemplary beverage dispenser according to the first aspect of the disclosure is shown with a top access door 175. The top access door 175 may engage with a corresponding hole 173 in the top surface of the beverage dispenser 100. The top access door 175 may be attached to the beverage dispenser by any known means, such as by hinge, latch, or through frictional engagement with the sidewalls of the hole 173. The top access door 175 enables reloading of any of the thermal tray 106, thermal drawer 161, or thermal drawer 165 without opening the front door 124 or the reduced height front door 169.

Figure 12:
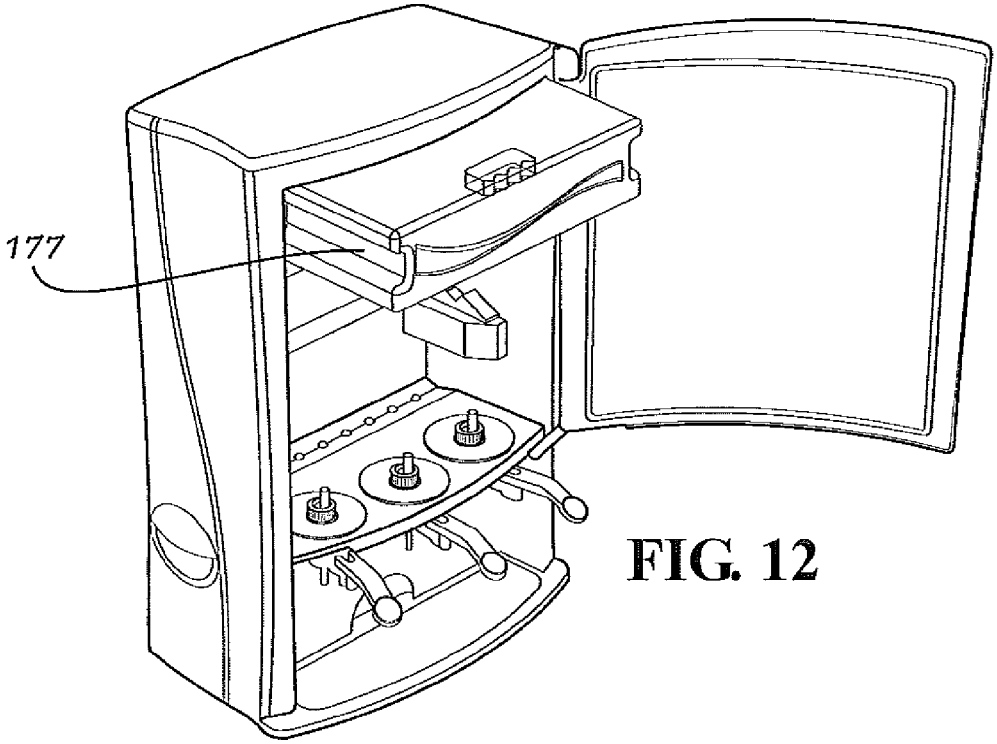
FIG. 12 illustrates a perspective view of an exemplary beverage dispenser according to the first aspect of the disclosure with a thermal package.

Referring to FIG. 12, a perspective view of an exemplary beverage dispenser according to the first aspect of the disclosure is shown with a thermal package 177. The thermal package 177 may be an enclosed package containing, for example, a re-freezable liquid or a re-heatable liquid or solid to enable regulating the temperature within the beverage compartment 104. The thermal package 177 enables quick swap outs with a fresh thermal package 177 when needed. Accordingly, the thermal package 177 is fully removable from the beverage dispenser 100. For example, upon a thermal package 177 melting, a freshly frozen thermal package 177 may be swapped out with the melted thermal package 177. Similar to the thermal drawers 161, 165 described above, the thermal package 177 may be installed above where the beverage containers are installed within the beverage compartment 104. Accordingly, the thermal package 177 may be replaced without removing any beverage containers installed within the beverage compartment 104.

Figure 13:
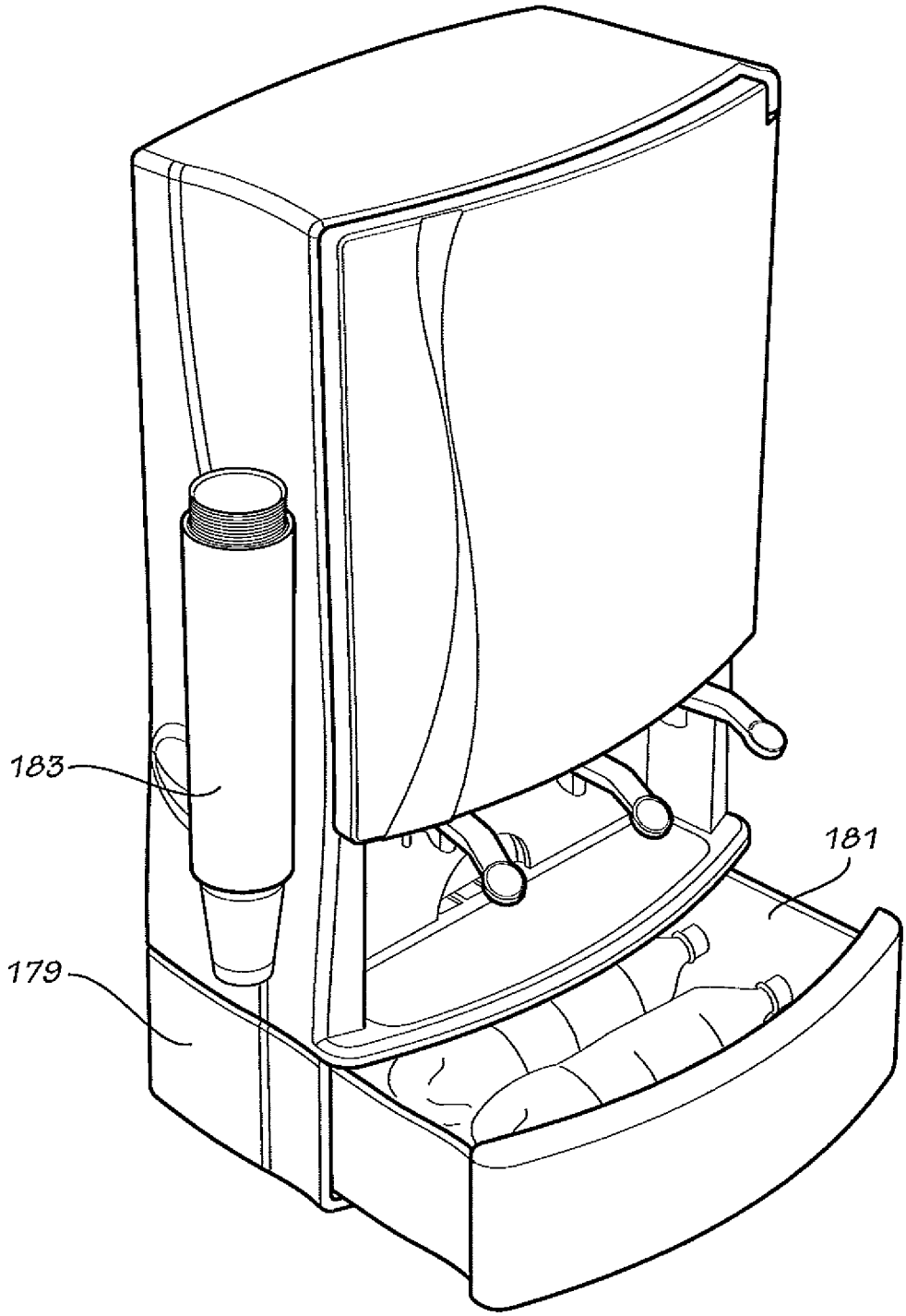
FIG. 13 illustrates a perspective view of an exemplary beverage dispenser according to the first aspect of the disclosure with a modular storage drawer and a cup holder.

Referring to FIG. 13, a perspective view of an exemplary beverage dispenser according to the first aspect of the disclosure is shown with a modular storage drawer 179 and a cup holder 183. The modular storage drawer 179 may be modularly attached to the beverage dispenser 100 to provide additional storage area 181 in addition to the pre-regulating drawer 114. The modular storage drawer 179 may be considered a modular beverage container storage compartment. In some embodiments, thermal regulant may be added to the storage area 181 to begin heating or cooling the beverage containers to a desired temperature. The beverage dispenser 100 may also include a cup holder 183 for holding cups or other containers usable by customers to hold dispensed beverages.

Figure 14:
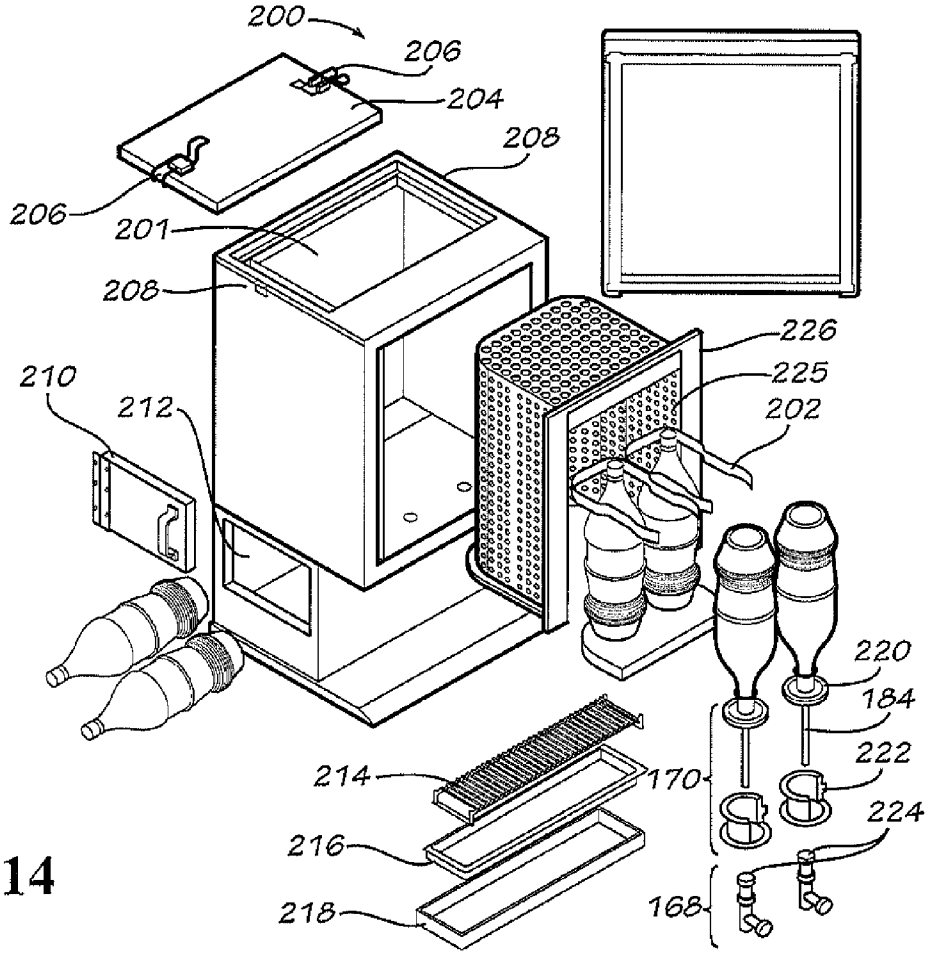
FIG. 14 illustrates an exploded view of an exemplary beverage dispenser according to a second aspect of the disclosure.

Referring to FIG. 14, an exploded view of an exemplary beverage dispenser 200 according to a second aspect of the disclosure is shown. The beverage dispenser 200 enables on demand and gravity fed dispensing of pre-mixed or otherwise ready to drink beverages that are thermally regulated through natural convection. The beverage dispenser 200 according to the second aspect of the disclosure includes a fixed thermal regulant storage area 201 separated from a beverage compartment 225 by a thermally conductive enclosure 226 that surrounds the beverage compartment 225. The enclosure 226 may include a plurality of perforations to facilitate convective heat transfer with the beverage compartment 225. The beverage compartment 225 provides a thermally regulated area in which to install a series of pre-mixed or otherwise ready to drink beverage containers for dispensing, but also in which to store a series of pre-mixed or otherwise ready to drink beverage containers behind the installed beverage containers. The temperature is regulated within the beverage compartment 225 through natural convection based on heat added or removed by one or more thermal regulants in the thermal regulant storage area 201. As shown in FIG. 14, the beverage compartment 225 enables two beverage containers to be installed for on demand dispensing and two beverage containers to be stored, though other numbers of beverage containers may be installed or stored within the beverage compartment 225.

The beverage containers installed within the beverage compartment 225 may be securely maintained with a container holder 202. In some embodiments, the container holder is a leaf spring that is shaped to conform to shape of the beverage containers installed within the beverage compartment 225. The leaf spring may also be shaped to avoid or otherwise go around the beverage containers stored within the beverage compartment.

Because the thermal regulant storage area 201 is fixed, the storage area 201 may be accessed by removing a lid 204 from the top of the beverage dispenser 200. The lid 204 may also be considered a top access door. The lid 204 may be attached to the beverage dispenser 200 by engaging latches 206 with latch points 208. It is contemplated by this disclosure that the lid 204 may be attached to the beverage dispenser in other ways, such as by hinge or any other lid attachment mechanism known to those of ordinary skill in the art.

Similar to the pre-regulating drawer 114 described above, the beverage dispenser 200 may include a pre-regulating compartment 212 accessible via a door 210 in the side of the beverage dispenser 200. In some embodiments, the pre-regulating compartment 212 may be replaced with the pre-regulating drawer 114, or vice versa. While the door 210, and corresponding portal, is shown to be attached to one side of the beverage dispenser, the door 210 may alternatively be attached to the other side, rear, or front of the beverage dispenser 200.

The beverage dispenser 200 may also include a slotted cup rest 214, a drain pan 216, and a drain pan holder 218. In some embodiments, the slotted cup rest 214, the drain pan 216, and the drain pan holder 218 may be replaced with a splash mat. Similarly, the splash mat shown with the cup rest 122 may be replaced with the slotted cup rest 214, the drain pan 216, and the drain pan holder 218.

Figure 15:
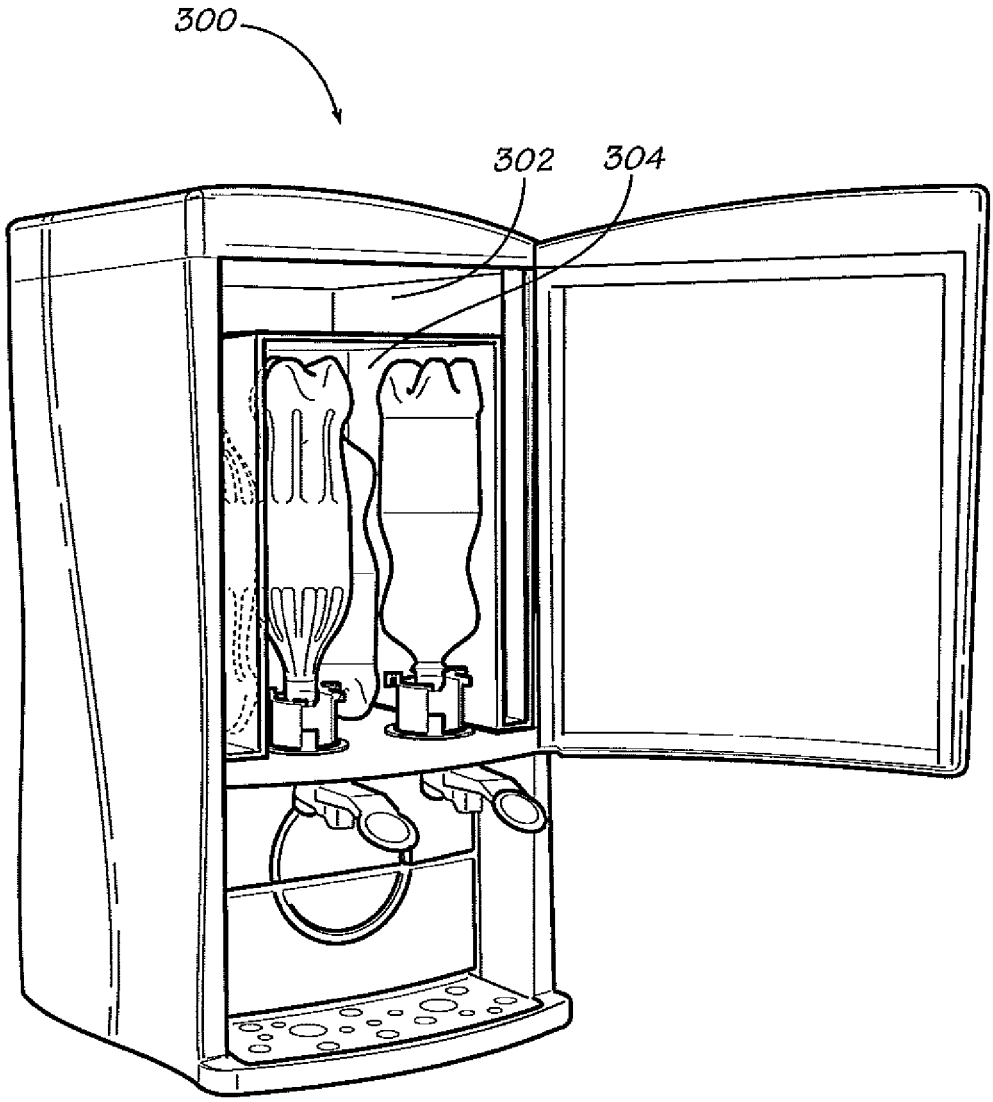
FIG. 15 illustrates a perspective view of an exemplary beverage dispenser according to a third aspect of the disclosure.
Figure 16:
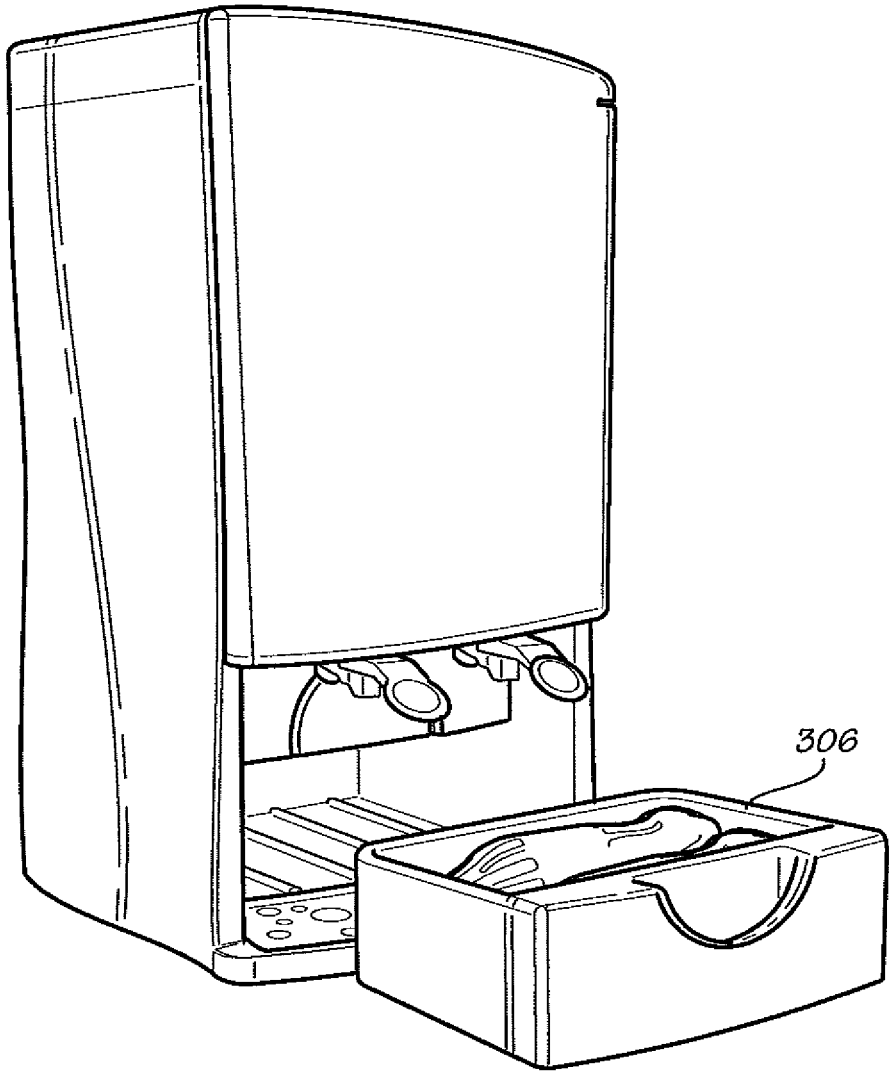
FIG. 16 illustrates a perspective view of an exemplary beverage dispenser according to the third aspect of the disclosure showing the storage drawer.
Figure 17:
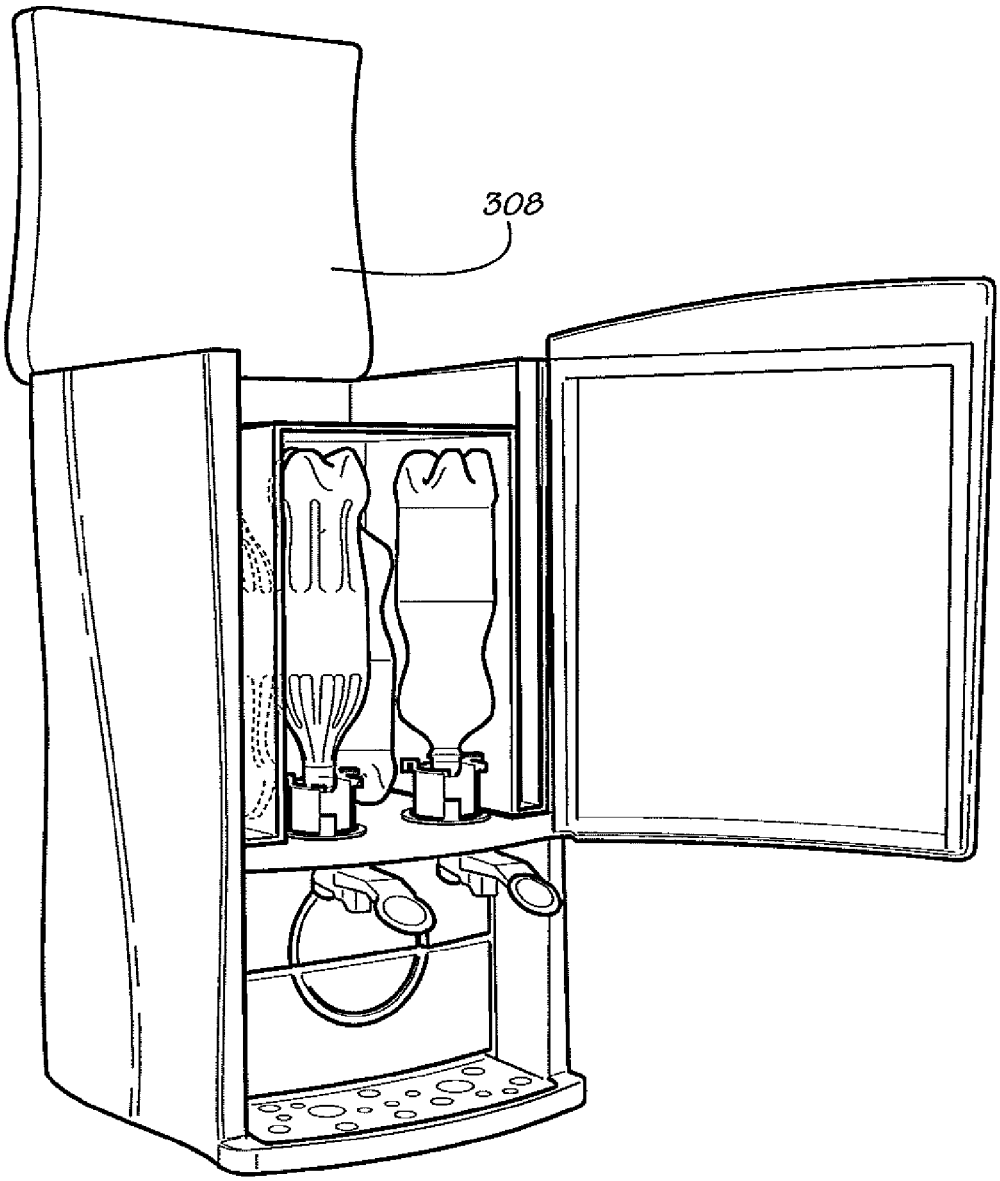
FIG. 17 illustrates a perspective view of an exemplary beverage dispenser according to the third aspect of the disclosure showing the top lid.

Referring to FIGS. 15-17, perspective views of an exemplary beverage dispenser 300 according to a third aspect of the disclosure are shown. The beverage dispenser 300 enables on demand and gravity fed dispensing of pre-mixed or otherwise ready to drink beverages that are thermally regulated through natural convection. Similar to the second aspect of the disclosure, the beverage compartment 304 may enable both storage and installation of pre-mixed or otherwise ready to drink beverage containers in the beverage dispenser 300. Also similar to the second aspect of the disclosure, the beverage dispenser 300 includes a fixed thermal regulant storage area 302 separated from the beverage compartment 304 by a thermally conductive enclosure. However, in contrast to the perforated enclosure in the beverage dispenser 200, the enclosure in the beverage dispenser 300 is solid, or in other words not perforated. The temperature is regulated within the beverage compartment 304 through natural convection based on heat added or removed by one or more thermal regulants in the thermal regulant storage area 302. As shown in FIG. 16, similar to the beverage dispenser 100, the beverage dispenser 300 includes a pre-regulating drawer 306 as opposed to the pre-regulating compartment 212 of the beverage dispenser 200. As shown in FIG. 17, the beverage dispenser 300 also includes a lid 308 to access the storage area 302. The lid 308 may also be considered a top access door. The lid 308 is shown to encompass the top of the beverage dispenser 300 and may be attached by any mechanism know to those of ordinary skill in the art, such as by a hinge.

Figure 18:
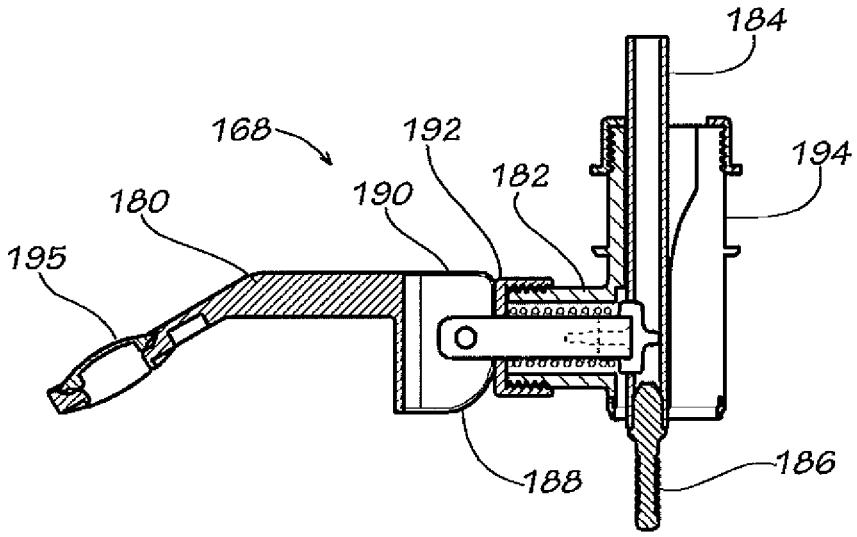
FIG. 18 illustrates a side view of a dispenser assembly in a dispensing state.
Figure 19:
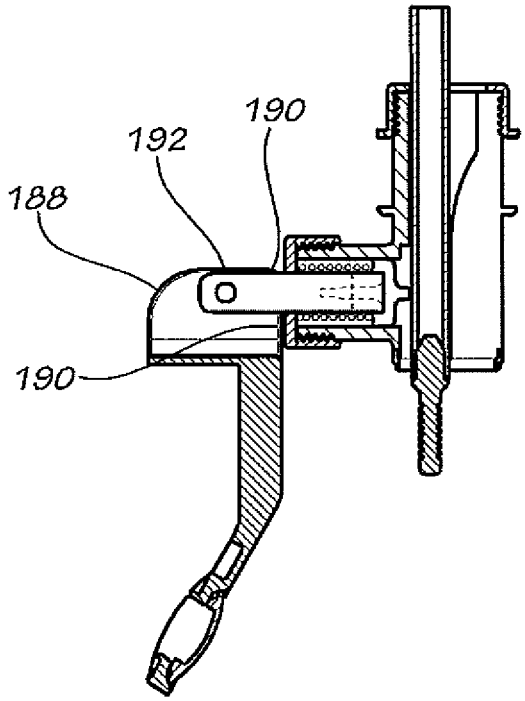
FIG. 19 illustrates a side view of the dispenser assembly in an installation state.

Referring to FIGS. 18 and 19, an exemplary dispenser assembly 168 is shown. The dispenser assembly 168 depicted in FIGS. 18 and 19 or any of the components that comprise the dispenser assembly 168 may be used with any of the aspects of the disclosure to enable on demand dispensing of beverage contents. FIG. 18 shows a side view of the dispenser assembly 168 in a dispensing state. The dispenser assembly 168 includes a handle 180 attached to a spring-tensioned valve 182 within the valve housing 194. The valve 182 is tensioned to crimp or otherwise impede the flow of fluid down the dispenser tube 184. During installation of beverage containers within the beverage dispensers described herein, a plug 186 may be attached to the bottom of the dispenser tube 184 to prevent unintended dispensing of beverage contents while the beverage container is inverted.

The handle 180 includes a first side 188 that is contoured to enable controlled dispensing of beverage contents. As the handle 180 is depressed, the handle 180 will rotate about the attachment point to the valve 182 along the contoured surface of the first side 188. When the handle 180 is depressed, the valve 182 at least partially un-crimps or otherwise allows the flow of fluid down the dispenser tube 184. When the handle is at rest in the dispensing state a flat second side 192 of the handle 180 is in contact with a corresponding flat surface of the valve housing 194. The handle may include a removable button 195 that may be colored or otherwise have indicia indicative of the beverage that is to be dispensed. If the beverage to be dispensed is changed, then the button 195 may similarly be changed.

To facilitate installation of the dispenser tube 184 through the valve housing 194, the dispenser assembly 168 may be manipulated to the installation state shown in FIG. 19. Specifically, when in the dispensing state, the handle 180 may be rotated about the valve 182 so as to be positioned upside down (e.g., the button 195 is facing down instead of facing up). Once the handle 180 is upside down, the handle 180 may be depressed to be placed in the installation state. As shown in FIG. 19, the installation state maintains the valve 182 in a fully opened position so as to prevent interference with removal or insertion of the dispenser tubing 184 through the valve housing 194. The handle 180 includes a flat third side 190 that maintains the handle in the depressed position. Specifically, the flat third side 190 stably rests against the corresponding flat surface of the valve housing 194. By requiring the handle 180 to be rotated to an upside down orientation to enable locking of the valve 182 open, customers are less likely to accidentally lock the valve 182 open while dispensing beverages.

Figure 20A:
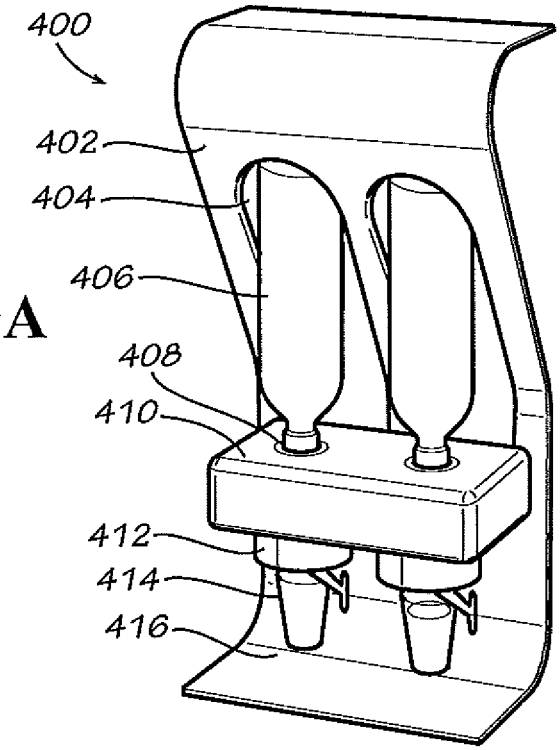
FIG. 20A illustrates a front perspective view of an exemplary beverage dispenser according to a fourth aspect of the disclosure.
Figure 20B:
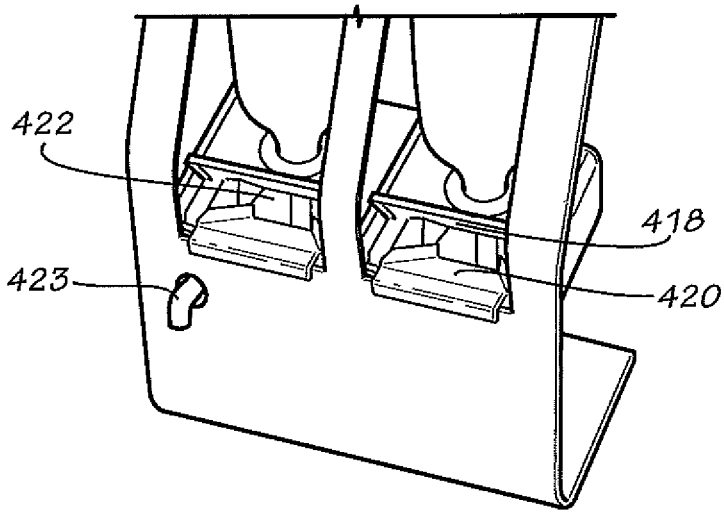
FIG. 20B illustrates a rear perspective view of an exemplary beverage dispenser according to a fourth aspect of the disclosure.

Referring to FIGS. 20A and 20B, perspective views of an exemplary beverage dispenser 400 according to a fourth aspect of the disclosure are shown. The beverage dispenser 400 enables on demand and gravity fed dispensing of pre-mixed or otherwise ready to drink beverages that are thermally regulated through natural convection. In contrast to the beverage dispensers described above with beverage compartments or beverage enclosures, the beverage dispenser 400 includes a base 402 to which one or more pre-mixed or otherwise ready to drink beverage containers 406 are installed and exposed to ambient conditions and are visible so that a customer may be assured of the beverage contents that will be dispensed. In some embodiments, the base 402 may have a sloped front face that has an elliptical cut-out or hole 404 through which each of the beverage containers 406 may be installed. Similar to the container mount 170 described above, the beverage dispenser 400 may include a container mount 408. The container mount 408 may be supported by a thermal regulation chamber 410 affixed to or integrally formed with the base 402. The thermal regulation chamber 410 is adapted to hold or store one or more thermal regulants and may be made of a thermally conductive material, such as aluminum. The thermal regulation chamber 410 is in thermal communication with, but fluidly isolated from a dispenser assembly 412. The dispenser assembly 412 is configured to dispense thermally regulated beverage contents from the beverage container 406 into a cup 414 or other container. The thermal regulation chamber 410 may also be considered a dispensing shelf because the upper side of the thermal regulation chamber 410 supports the container mount 408 and beverage containers installed therein and the lower side of the thermal chamber 410 supports the dispenser assembly 412. The base 402 may include a cup rest 416 for supporting the cup 414 or other container during on demand dispensing operations.

The thermal regulation chamber 410, and specifically the thermal regulant storage area 422, enables thermally regulating the beverage contents stored in the dispenser assembly 412. For example, with iced stored in the thermal regulant storage area 422, natural convection currents may be established in the beverage contents stored in the dispenser assembly 412 to cool the beverage contents. In other words, the temperature of the beverage contents stored in the dispenser assembly 412 is regulated through natural convection based on heat added or removed by one or more thermal regulants in the thermal regulant storage area 422.

For each beverage container location on the base 402, the thermal regulation chamber 410 includes a rear lid 418 and a chute 420 for accessing a thermal regulant storage area 422. The chute 420 directs thermal regulant being loaded into the thermal regulation chamber 410 into the thermal regulant storage area 422. For example, when cooling beverage contents, the chute 420 may direct ice into the thermal regulant storage area 422. Similarly, when warming beverage contents, the chute 420 may direct hot water or other heating thermal regulant into the thermal regulant storage area 422. The thermal regulant storage area 422 may include a drain 423 for draining excess fluids from the thermal regulant storage area 422, such as ice melt. While only one drain 423 is shown, a drain 423 may be provided for each thermal regulant storage area 422.

Figure 21B:
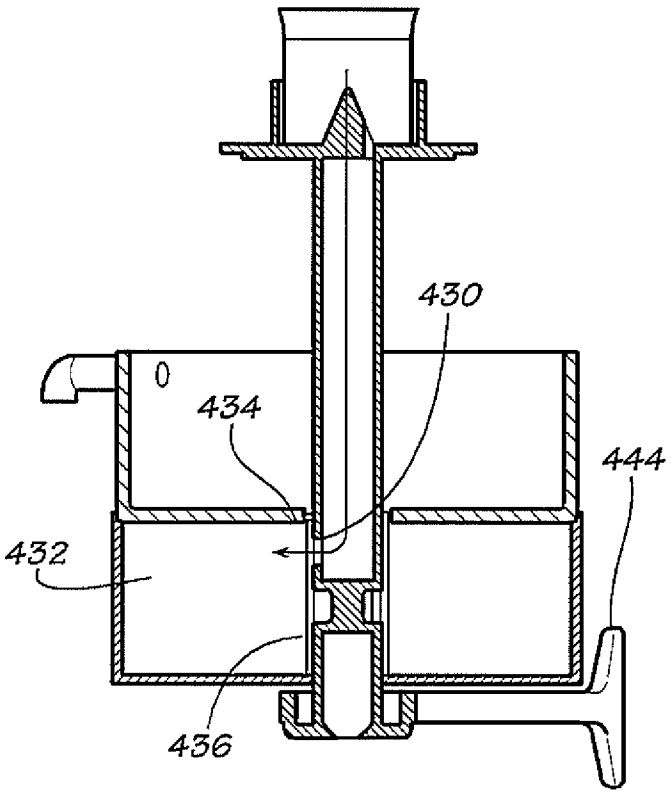
FIG. 21B illustrates a second side view of a dispenser assembly of the exemplary beverage dispenser according to the fourth aspect of the disclosure.
Figure 21A:
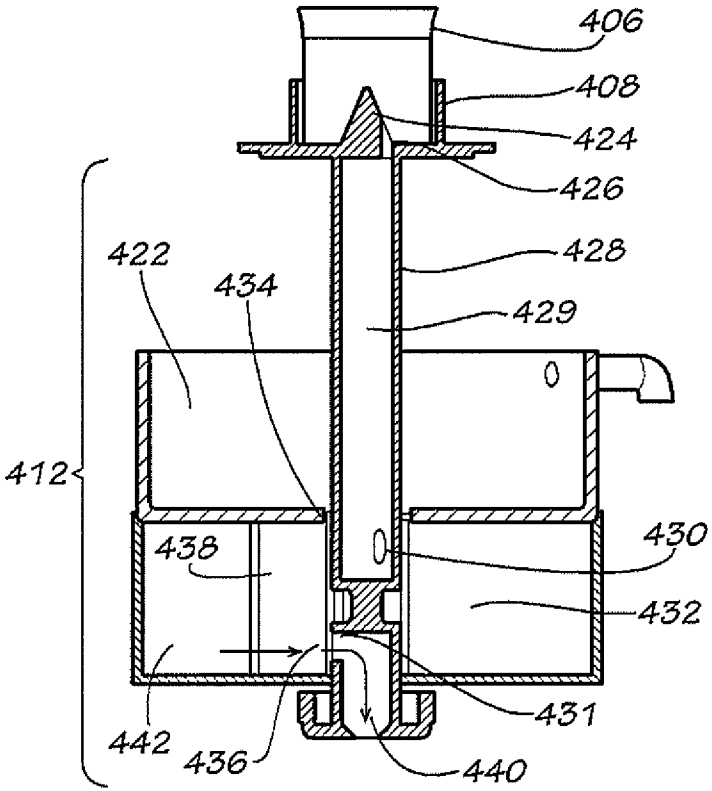
FIG. 21A illustrates a first side view of a dispenser assembly of the exemplary beverage dispenser according to the forth aspect of the disclosure.

Referring to FIGS. 21A and 21B, side views of the dispenser assembly 412 of the exemplary beverage dispenser 400 according to the forth aspect of the disclosure are shown. The dispenser assembly 412 is attached to the container mount 408, which is in turn attached to an installed beverage container 406. The dispenser assembly 412 includes a piercing tip 424 with a fluid communication port 426 on the top of a rotatable dispensing stem 428. In some embodiments, the piercing tip 424 and the fluid communication port 426 may be incorporated as part of the container mount 408 as opposed to being part of the dispenser assembly 412. The piercing tip 424 enables a cap of the beverage container 406 to be pierced to enable dispensing of beverage contents. By piercing the cap of the beverage container 406, a merchant may be discouraged from attempting to refill and reuse the beverage container 406 to dispense unwanted beverage contents.

The rotatable dispensing stein 428 includes a first fluid communication port 430 at the base of a first fluid communication path 429 within the rotatable dispensing stem 428. The first fluid communication port 430 enables refilling a pre-dosed beverage compartment 432 in the dispenser assembly 412. In other words, the beverage compartment 432 is of a pre-determined volume so as to store a desired dose of beverage contents. The rotatable dispensing stein 428 also includes a second fluid communication port 431 at the top of a second fluid communication path 440. The second fluid communication port 431 and the second fluid communication path 440 enable dispensing of beverage contents stored in a pre-dosed beverage compartment 438 out of the bottom of the second fluid communication path 440. The first fluid communication path 429 and the second fluid communication path 440 are not in direct fluid communication with each other.

The first fluid communication port 430 and the second fluid communication port 431 are offset from each other about the circumference of the rotatable dispensing stem 428. For example, with three pre-dosed beverage compartments, the first fluid communication port 430 and the second fluid communication port 431 may be offset from each other by about 120°. Accordingly, while one beverage compartment is dispensing beverage contents, another beverage compartment is refilling with beverage contents. Following the above example of three-pre-dosed beverage compartments, a pre-dosed beverage compartment 442 may remain empty after dispensing beverage contents before being refilled. Alternatively, the rotatable dispensing stem 428 may include a plurality of fluid communication ports at the bottom of the first fluid communication path 429 such that only the beverage compartment currently selected to dispense beverage contents may not have a corresponding fluid communication port at the bottom of the first fluid communication path 429. That is, a third fluid communication port (not shown) may enable simultaneous refilling of beverage compartment 432 and beverage compartment 442. Accordingly, only the beverage compartment currently selected to dispense beverage contents may be empty after dispensing beverage contents.

Each beverage compartment 432, 438, 442 includes a top fluid communication port 434 and a bottom fluid communication port 436. The top fluid communication port 434 and the bottom fluid communication port 436 are vertically aligned with the rotatable dispensing stem 428. When the first fluid communication port 430 is aligned with the top fluid communication port 434, beverage contents from the beverage container 406 may refill the corresponding beverage compartment. For example, as shown in FIG. 21B, the first fluid communication port 430 is aligned with the top fluid communication port 434 of the pre-dosed beverage compartment 432. Also shown, the bottom fluid communication port 436 is misaligned or not aligned with the second fluid communication port 431. Accordingly, beverage contents from the beverage container 406 flow through the first fluid communication path 429 and into the pre-dosed beverage compartment 432. At the same time, the beverage contents from the pre-dosed beverage compartment 432 are prevented from being dispensed through the second fluid communication path 440.

When the second fluid communication port 431 is aligned with the bottom fluid communication port 436, beverage contents stored in the beverage compartment are dispensed out the bottom of the second fluid communication path 440. For example, as shown in FIG. 21A, the second fluid communication port 431 is aligned with the bottom fluid communication port 436 of the pre-dosed beverage compartment 438. Also shown, the top fluid communication port 434 is misaligned or not aligned with the first fluid communication port 430. Accordingly, beverage contents stored in the pre-dosed beverage compartment 438 flow through the second fluid communication path 440 and are dispensed for consumption. At the same time, the beverage contents from the beverage container 406 are prevented from flowing through the first fluid communication path 429 and into the pre-dosed beverage compartment 438.

Figure 21C:
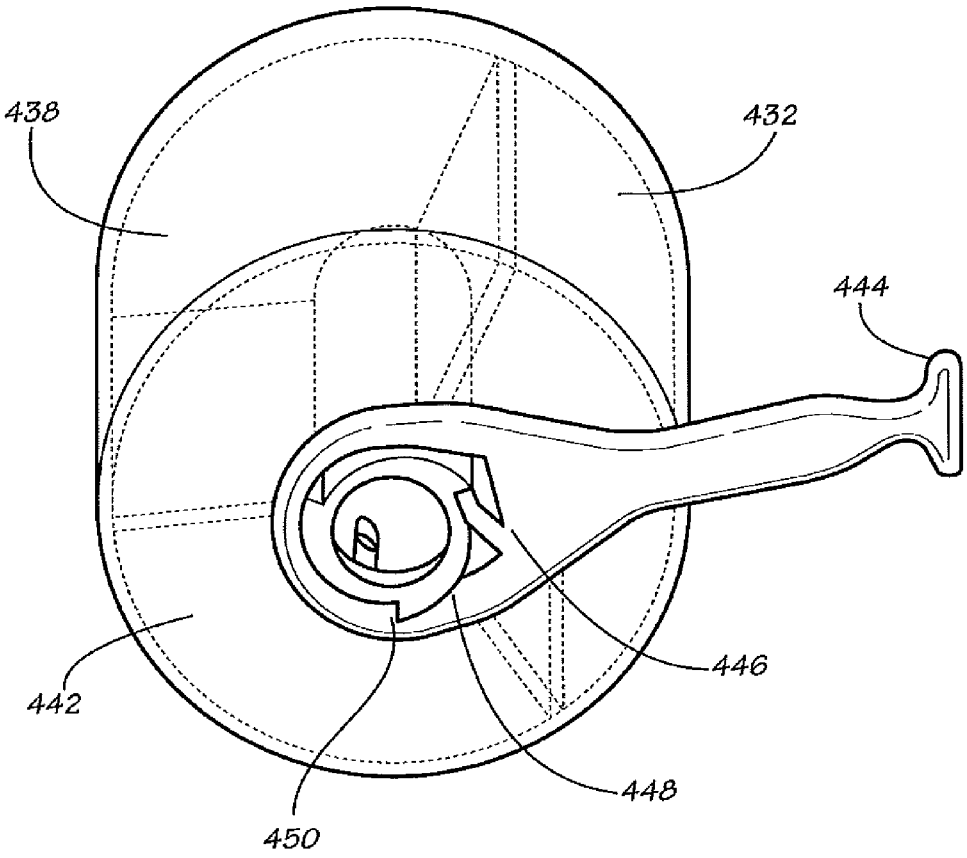
FIG. 21C illustrates a perspective view of the dispenser assembly of the exemplary beverage dispenser according to the forth aspect of the disclosure.

The rotatable dispensing stem 428 may be affixed to and rotated by a handle 444. Alternatively, the handle may be affixed to and rotate the carousel of beverage compartments 432, 438, 442 about a stationary dispensing stem 428. Referring to FIG. 21C, a perspective view of the dispenser assembly 412 of the exemplary beverage dispenser 400 according to the forth aspect of the disclosure are shown. The handle 444 may include a catch 446 that may be tensioned against the carousel of beverage compartments 432, 438, 442. Upon rotating the handle 444, the catch 446 may travel along a cam 448. Upon reaching the end of the cam 448, the catch 446 may snap back against the carousel of beverage compartments 432, 438, 442. The cam 448 may include a ridge 450 to prevent rotating the handle in the opposite direction.

While described in conjunction with the fourth aspect of the disclosure, the dispenser assembly 412 or any of the components that comprise the dispenser assembly 412 may be used with any of the aspects of the disclosure.

Figure 22A:
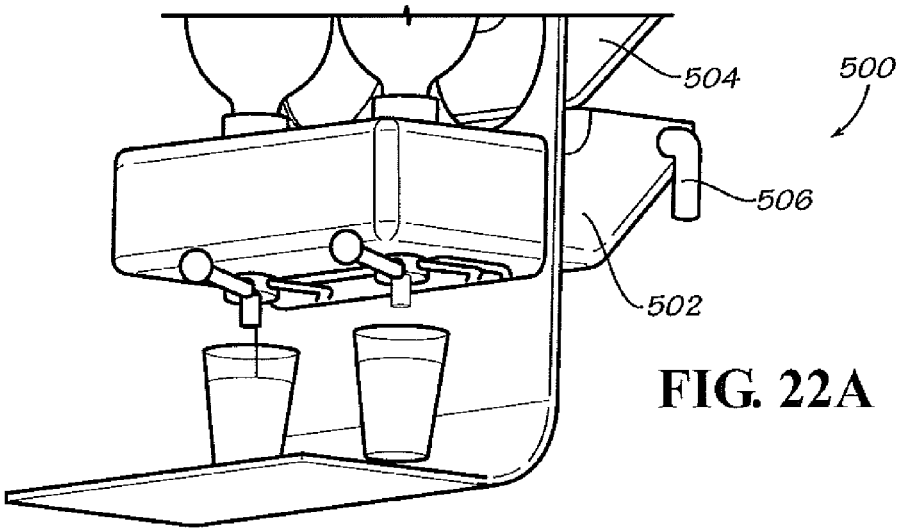
FIG. 22A illustrates a perspective view of an exemplary beverage dispenser according to a fifth aspect of the disclosure.
Figure 22B:
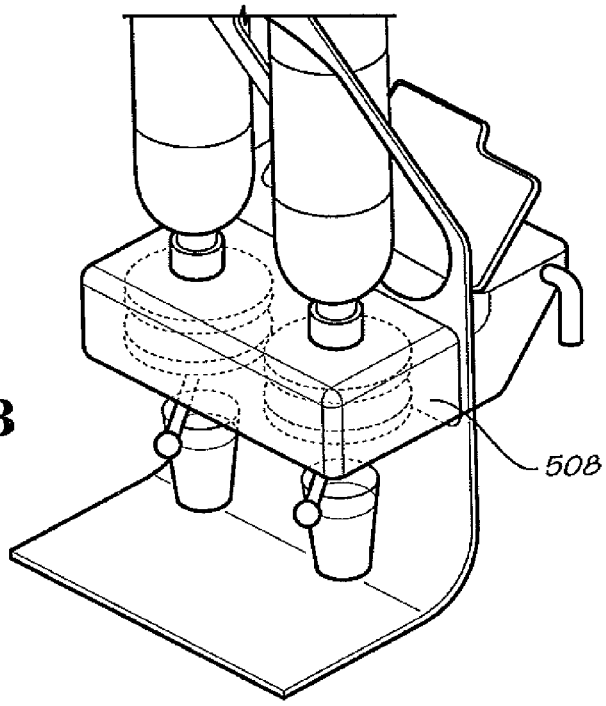
FIG. 22B illustrates another perspective view of the exemplary beverage dispenser according to the fifth aspect of the disclosure.

Referring to FIGS. 22A and 22B, perspective views of an exemplary beverage dispenser 500 according to a fifth aspect of the disclosure are shown. The beverage dispenser 500 enables on demand and gravity fed dispensing of pre-mixed or otherwise ready to drink beverages that are thermally regulated through natural convection. Similar to the beverage dispenser 400, the beverage dispenser 500 includes a base with container mounts for mounting pre-mixed or otherwise drink ready beverage containers exposed to view and ambient conditions. Also similar to the beverage dispenser 400, the beverage dispenser 500 includes a thermal regulation chamber 502 adapted to hold or store one or more thermal regulants in a thermal regulant storage area. The thermal regulation chamber 502 may be considered a dispensing shelf. However, unlike the beverage dispenser 400, the thermal regulation chamber 502 is a single unit for all of the beverage container installation locations. The thermal regulation chamber 502 includes a rear facing lid 504 for loading thermal regulant into the thermal regulation chamber 502 and also includes a drain 506 for draining excess fluids from the thermal regulation chamber 502. Also unlike the beverage dispenser 400, the thermal regulation chamber 502 of the beverage dispenser 500 encompasses the pre-dosed beverage compartments of the dispenser assembly 508.

The thermal regulation chamber 502 enables thermally regulating the beverage contents stored in pre-dosed beverage compartments of a dispenser assembly 508. For example, with iced stored in the thermal regulation chamber 502, natural convection currents may be established in the beverage contents stored in the pre-dosed beverage compartments to cool the beverage contents. In other words, the temperature of the beverage contents stored in the pre-dosed beverage compartments is regulated through natural convection based on heat added or removed by one or more thermal regulants in the thermal regulation chamber 502.

Figure 23B:
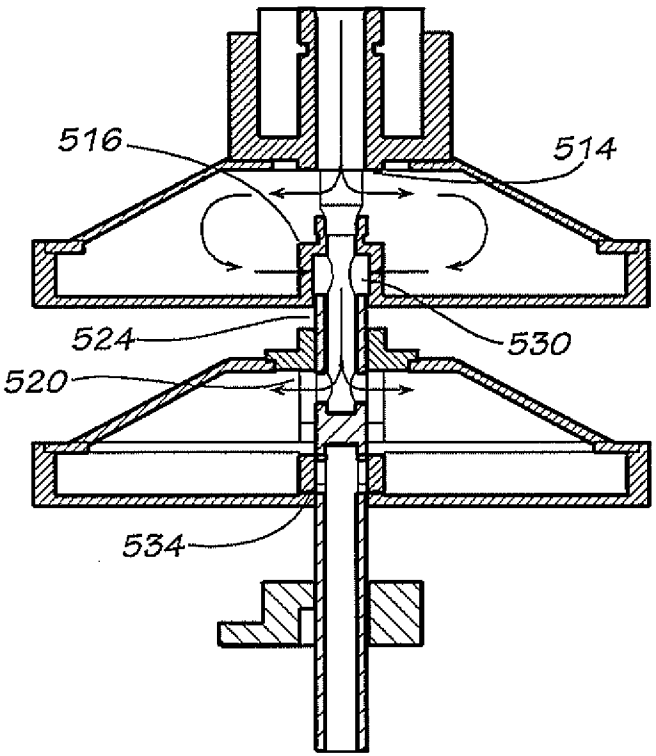
FIG. 23B illustrates a second side view of a dispenser assembly of the exemplary beverage dispenser according to the fifth aspect of the disclosure in a refilling state.
Figure 23A:
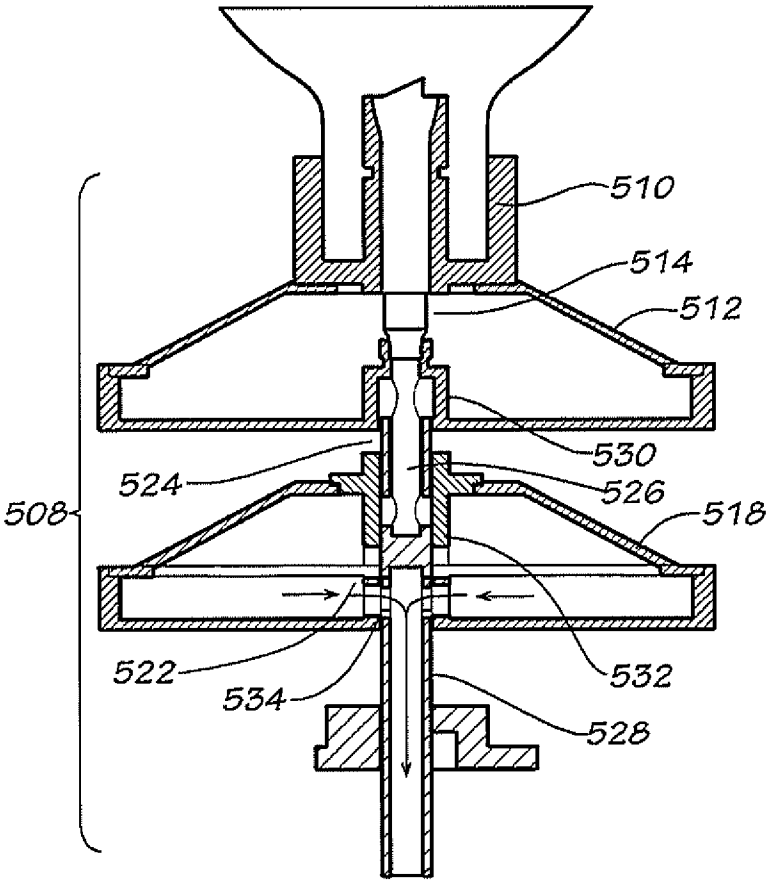
FIG. 23A illustrates a first side view of a dispenser assembly of the exemplary beverage dispenser according to the fifth aspect of the disclosure in a dispensing state.

Referring to FIGS. 23A and 23B, side views of a dispenser assembly 508 of the exemplary beverage dispenser 500 according to the fifth aspect of the disclosure are shown in dispensing and refilling states. The dispenser assembly 508 includes a first fluid flow path 510 for flowing beverage contents from a beverage container into a top pre-dosed beverage compartment 512. The top beverage compartment 512 may include a top fluid communication port 514 and a bottom fluid communication port 516. The top fluid communication port 514 is in fluid communication with the first fluid flow path 510 and may be unregulated or otherwise remain open. The bottom fluid communication port 516 enables the beverage contents stored in the top beverage compartment 512 to be flowed to a bottom pre-dosed beverage compartment 518. In some embodiments the bottom fluid communication port 516 may comprise a pair of fluid communication ports offset from each other, for example by about 180°.

Similar to the top beverage compartment 512, the bottom beverage compartment 518 includes a top fluid communication port 520 and a bottom fluid communication port 522 that are offset from each other circumferentially. For example, the top fluid communication port 520 may be offset from the bottom fluid communication port 522 by about 90°. In some embodiments the top fluid communication port 520 and the bottom fluid communication port 522 may comprise a pair of fluid communication ports offset from each other, for example by about 180°.

The top beverage compartment 512 may be fluidly connected to the bottom beverage compartment 518 through a rotatable dispensing stem 524. The rotatable dispensing stem 524 includes a second fluid flow path 526 and a third fluid flow path 528. The second fluid flow path 526 and the third fluid flow path 528 are not in direct fluid communication with each other. The second fluid flow path 526 may engage in fluid communication with the top beverage compartment 512 through a first fluid communication port 530 on the dispensing stem 524 at the top of the second fluid flow path 526. The second fluid flow path 526 may also engage in fluid communication with the bottom beverage compartment 518 through a second fluid communication port 532 on the dispensing stem 524 at the bottom of the second fluid flow path 526. The first fluid communication port 530 and the second fluid communication port 532 may be circumferentially aligned along the dispensing stem 524. In some embodiments the first fluid communication port 530 and the second fluid communication port 532 may each comprise a pair of fluid communication ports offset from each other, for example by about 180°.

The third fluid flow path 528 may engage in fluid communication with the bottom beverage compartment 518 through a third fluid communication port 534 on the dispensing stem 524 at the top of the third fluid flow path 528. In some embodiments the third fluid communication port 534 may comprise a pair of fluid communication ports offset from each other, for example by about 180°. The third fluid communication port 534 may be circumferentially offset from the first and second fluid communication ports 530, 532 on the dispensing stem 524. For example, the third fluid communication port 534 may be offset from the first and second fluid communication ports 530, 532 by about 90°.

As shown in FIG. 23A, when the dispenser assembly 508 is in a dispensing state, the bottom fluid communication port 522 of the bottom beverage compartment 518 is in alignment with the third fluid communication port 534 at the top of the third fluid flow path 528 of the dispensing stem 524. Therefore, beverage contents stored in the bottom beverage compartment 518 are allowed to flow through the third fluid flow path 528 and be dispensed from the beverage dispenser 500. At the same time, the second fluid communication port 532 is offset from the top fluid communication port 520 of the bottom beverage compartment 518, thereby preventing beverage contents from flowing into the bottom beverage compartment 518 from the beverage container or the top beverage compartment 512.

As shown in FIG. 23B, when the dispenser assembly 508 is in a refilling state, the bottom fluid communication port 516 of the top beverage compartment 512 is in alignment with the first fluid communication port 530 at the top of the second fluid flow path 526 of the dispensing stem 524. Therefore, beverage contents are allowed to flow from the beverage container, through the first fluid flow path 510 into the top beverage compartment 512 and through the second fluid flow path 526 into the bottom beverage compartment 518. At the same time, the third fluid communication port 534 is offset from the bottom fluid communication port 522 of the bottom beverage compartment 518, thereby preventing dispensing of beverage contents through the third fluid flow path 528. In some embodiments the dispenser assembly 508 may be spring biased in the refilling state so as to prevent accidental dispensing of beverage contents.

Figure 23C:
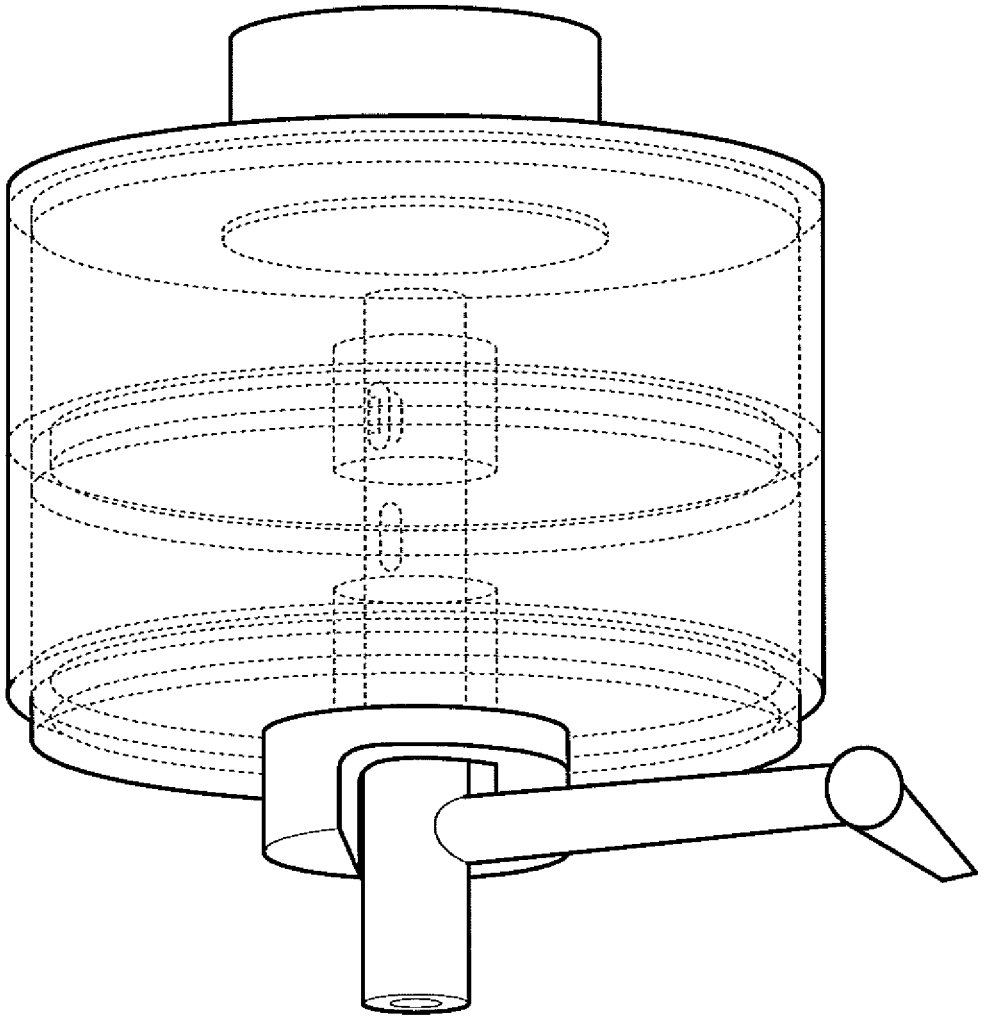
FIG. 23C illustrates a perspective view of a dispenser assembly of the exemplary beverage dispenser according to the fifth aspect of the disclosure.

The top beverage compartment 512 and the bottom beverage compartment 518 may be separated from each other by a distance so as to allow thermal regulant to accumulate around both beverage compartments 512, 518. Moreover, the beverage compartments 512, 518 may have sloped or fluted upper walls to prevent the buildup of gas pockets within the beverage compartments 512, 518. Buildup of gas within the beverage compartments 512, 518 may lead to thermal inefficiencies when regulating the temperature of beverage contents stored in the beverage compartments 512, 518. FIG. 23C shows an alternative beverage dispenser assembly 508, where the top and bottom beverage compartments 512, 518 are cylindrical in shape and are stacked on top of each other. Otherwise, the beverage dispenser assembly shown in FIG. 23C is constructed and operates as described above in conjunction with FIGS. 23A and 23B.

While described in conjunction with the fifth aspect of the disclosure, the dispenser assembly 508 or any of the components that comprise the dispenser assembly 508 may be used with any of the aspects of the disclosure.

Figure 24:
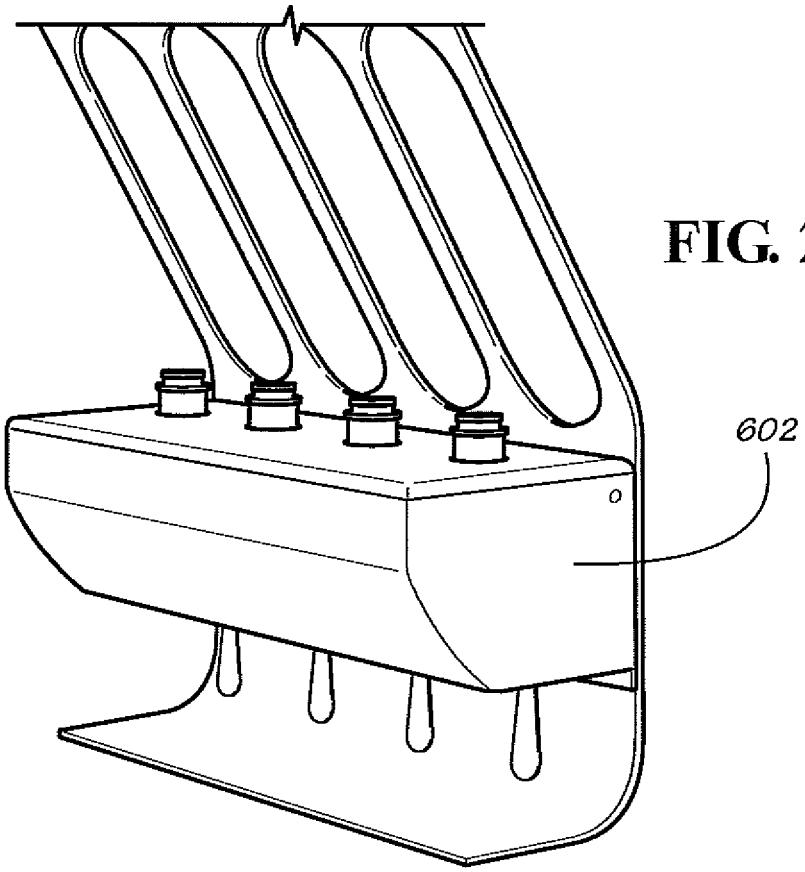
FIG. 24 illustrates a perspective view of a beverage dispenser according to a sixth aspect of the disclosure.
Figure 25:
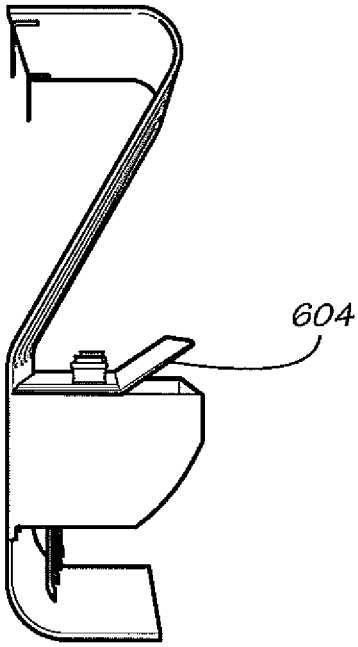
FIG. 25 illustrates a side perspective view of the beverage dispenser according to the sixth aspect of the disclosure
Figure 26:
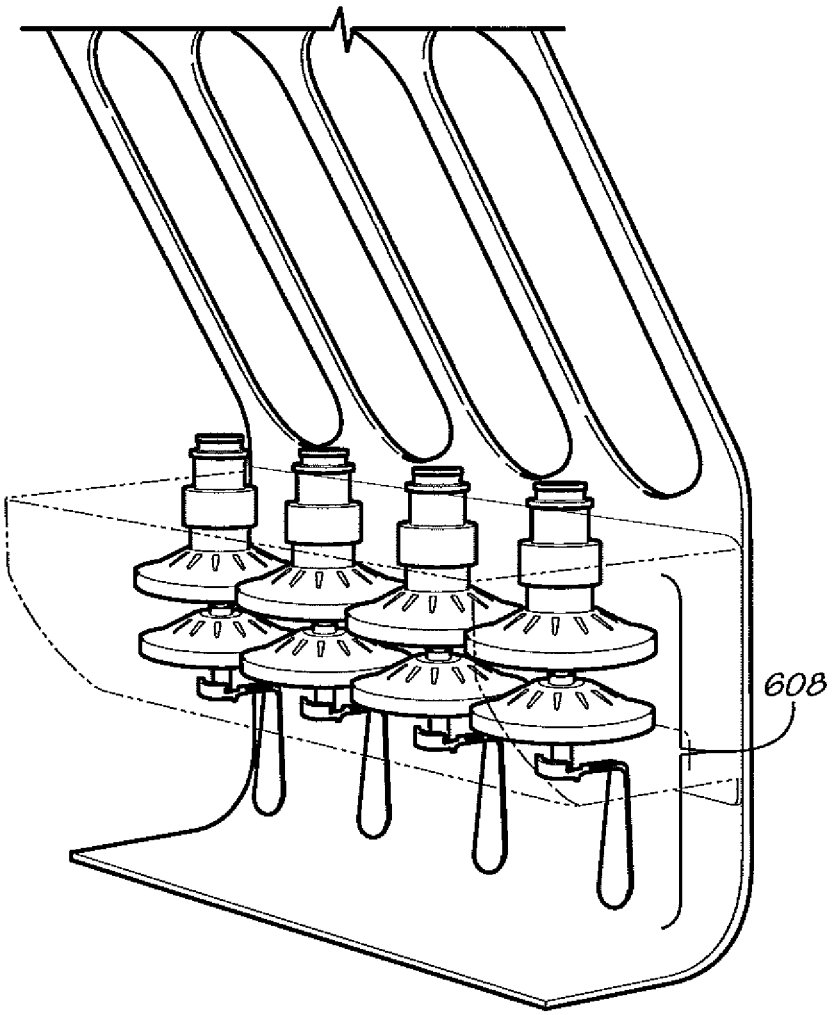
FIG. 26 illustrates a see-through perspective view of the beverage dispenser according to the sixth aspect of the disclosure.

Referring to FIGS. 24-26, perspective views of an exemplary beverage dispenser 600 according to a sixth aspect of the disclosure are shown. The beverage dispenser 600 enables on demand and gravity fed dispensing of pre-mixed or otherwise ready to drink beverages that are thermally regulated through natural convection. The beverage dispenser 600 is substantially similar to the beverage dispenser 500 according to the fifth aspect of the disclosure except the thermal regulation chamber 602 has a forward facing lid 604. The thermal regulation chamber 602 may also be considered a dispensing shelf. The thermal regulation chamber 602 adapted to hold or store one or more thermal regulants in a thermal regulant storage area. The beverage dispenser 600 also includes an "L" bracket 606 for attaching the base of the beverage dispenser 600 to a wall or other surface. While the bracket 606 has been described in conjunction with the sixth aspect of the disclosure, the bracket 606 may be used with any of the aspects of the disclosure. The beverage dispenser 600 further includes a lever-based dispenser assembly 608 that is carried within the thermal regulation chamber 602.

The thermal regulation chamber 602 enables thermally regulating the beverage contents stored in beverage compartments of the dispenser assembly 608. For example, with iced stored in the thermal regulation chamber 602, natural convection currents may be established in the beverage contents stored in beverage compartments of the dispenser assembly 608 to cool the beverage contents. In other words, the temperature of the beverage contents stored in the beverage compartments is regulated through natural convection based on heat added or removed by one or more thermal regulants in the thermal regulation chamber 602.

Figure 27A:
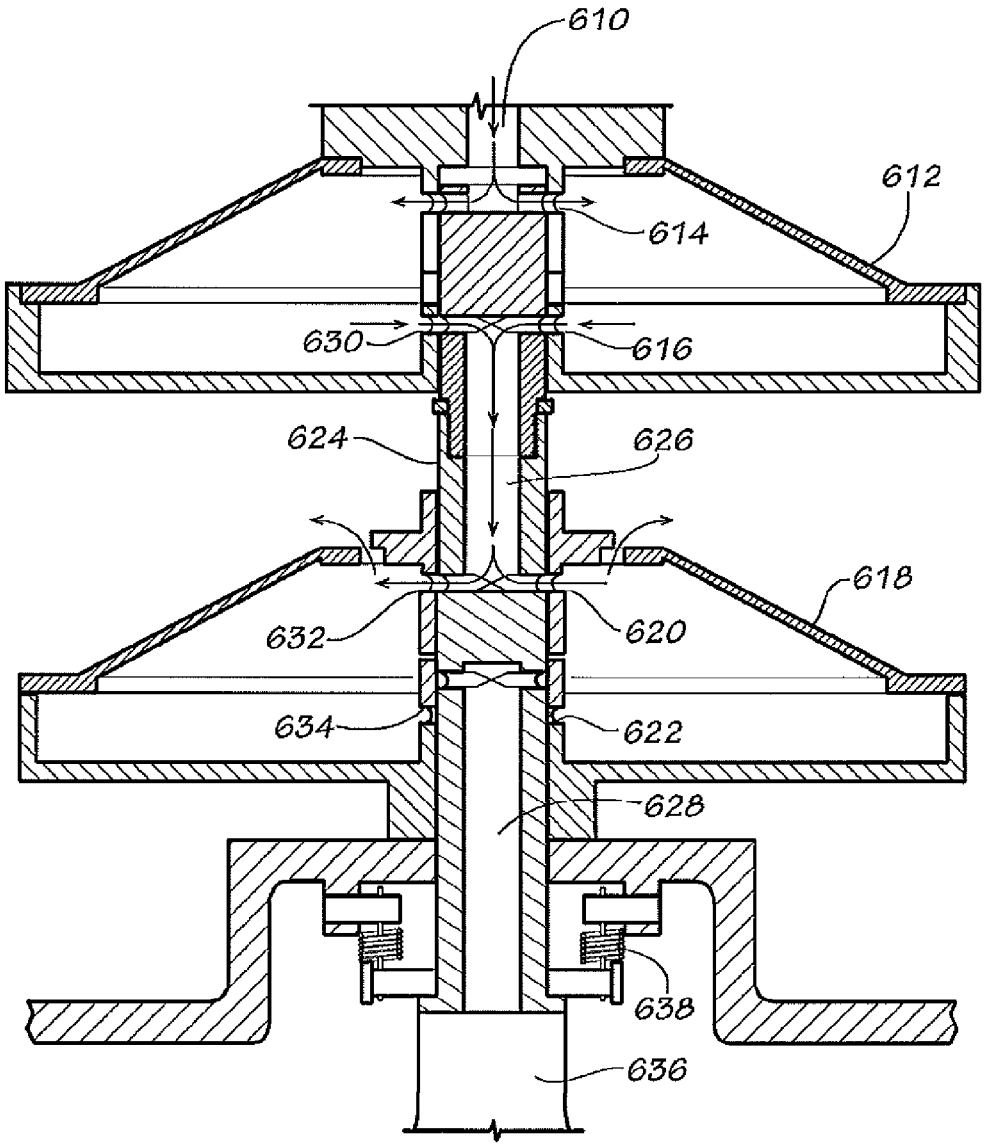
FIG. 27A illustrates a side view of a dispenser assembly of the exemplary beverage dispenser according to the sixth aspect of the disclosure in a refilling state.
Figure 27B:
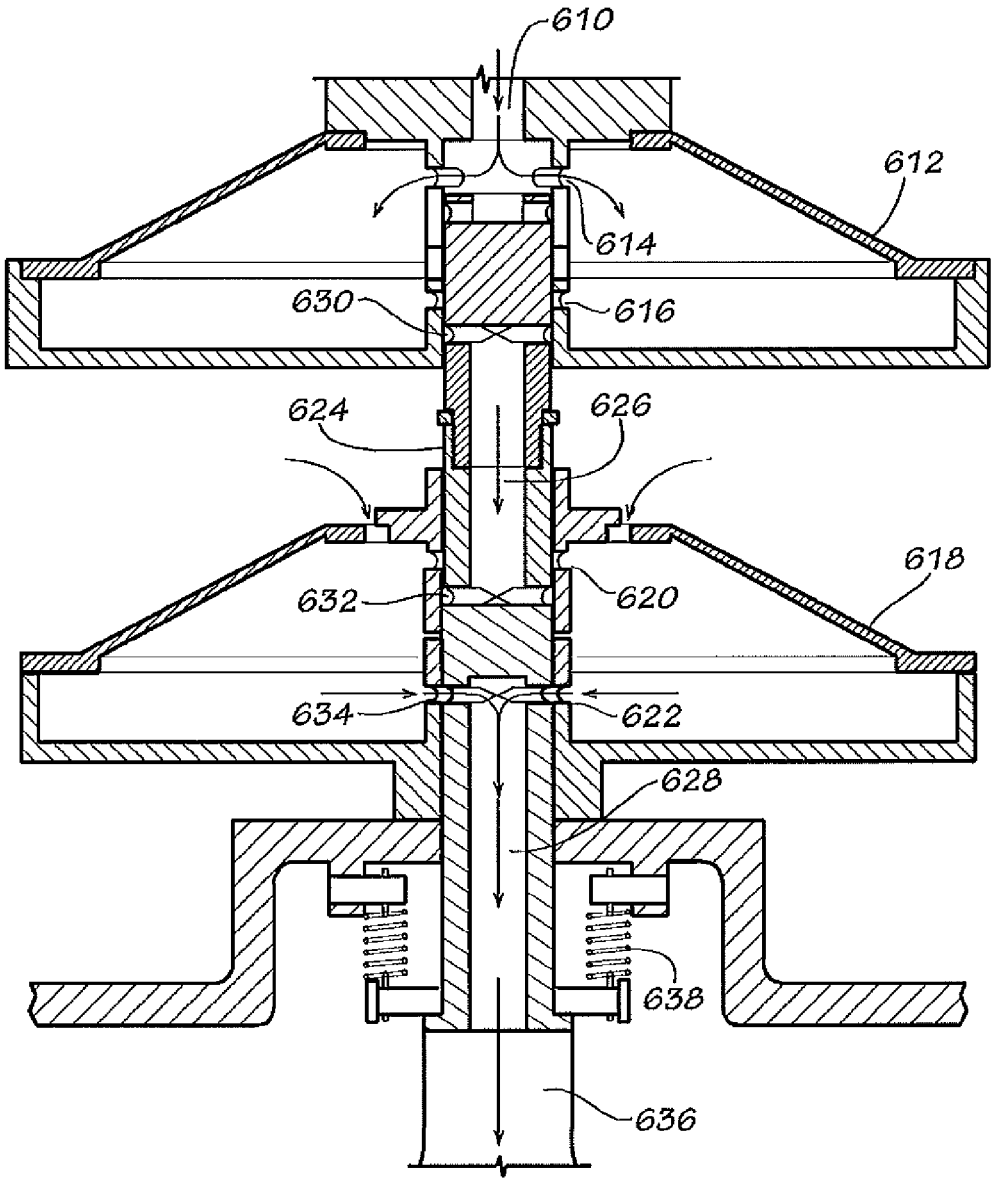
FIG. 27B illustrates a side view of a dispenser assembly of the exemplary beverage dispenser according to the sixth aspect of the disclosure in a dispensing state.

Referring to FIGS. 27A and 27B, side views of a dispenser assembly 608 of the exemplary beverage dispenser 600 according to the sixth aspect of the disclosure are shown in dispensing and refilling states. The dispenser assembly 608 includes a first fluid flow path 610 for flowing beverage contents from a beverage container into a top pre-dosed beverage compartment 612. The top beverage compartment 612 may include a top fluid communication port 614 and a bottom fluid communication port 616 that may be aligned with each other circumferentially. The top fluid communication port 614 enables beverage contents from a pre-mixed or otherwise ready to drink beverage container to be flowed into the top beverage compartment 612. The bottom fluid communication port 616 enables the beverage contents stored in the top beverage compartment 612 to be flowed to a bottom pre-dosed beverage compartment 618. In some embodiments the top fluid communication port 614 and the bottom fluid communication poll 616 may each comprise a pair of fluid communication ports offset from each other, for example by about 180°. In other embodiments the top fluid communication port 614 and the bottom fluid communication port 616 may each comprise more than two of fluid communication ports offset from each other.

Similar to the top beverage compartment 612, the bottom beverage compartment 618 includes a top fluid communication port 620 and a bottom fluid communication port 622 that may be aligned with each other circumferentially. In some embodiments the top fluid communication port 620 and the bottom fluid communication port 622 may comprise a pair of fluid communication ports offset from each other, for example by about 180°. In other embodiments the top fluid communication port 620 and the bottom fluid communication poll 622 may each comprise more than two of fluid communication ports offset from each other.

The top beverage compartment 612 may be fluidly connected to the bottom beverage compartment 618 through a vertically displaceable dispensing stem 624. The vertically displaceable dispensing stem 624 includes a second fluid flow path 626 and a third fluid flow path 628. The second fluid flow path 626 and the third fluid flow path 628 are not in direct fluid communication with each other. The second fluid flow path 626 may engage in fluid communication with the top beverage compartment 612 through a first fluid communication port 630 on the dispensing stem 624 at the top of the second fluid flow path 626. The second fluid flow path 626 may also engage in fluid communication with the bottom beverage compartment 618 through a second fluid communication port 632 on the dispensing stem 624 at the bottom of the second fluid flow path 626. The first fluid communication port 630 and the second fluid communication port 632 may be circumferentially aligned along the dispensing stem 624. In some embodiments the first fluid communication port 630 and the second fluid communication port 632 may each comprise a pair of fluid communication ports offset from each other, for example by about 180°. In other embodiments the first fluid communication port 630 and the second fluid communication port 632 may each comprise more than two of fluid communication ports offset from each other.

The third fluid flow path 628 may engage in fluid communication with the bottom beverage compartment 618 through a third fluid communication port 634 on the dispensing stem 624 at the top of the third fluid flow path 628. In some embodiments the third fluid communication port 634 may comprise a pair of fluid communication ports offset from each other, for example by about 180°. In other embodiments the third fluid communication port 634 may comprise more than two of fluid communication ports offset from each other.

As shown in FIG. 27A, when the dispenser assembly 608 is in a refilling state, the bottom fluid communication port 616 of the top beverage compartment 612 is in alignment with the first fluid communication port 630 at the top of the second fluid flow path 626 of the dispensing stem 624. Therefore, beverage contents are allowed to flow from the beverage container, through the first fluid flow path 610 into the top beverage compartment 612 and through the second fluid flow path 626 into the bottom beverage compartment 618. At the same time, the third fluid communication port 634 is vertically offset from the bottom fluid communication port 622 of the bottom beverage compartment 618, thereby preventing dispensing of beverage contents through the third fluid flow path 628. In some embodiments the dispenser assembly 608 may be biased with a spring 638 to the refilling state so as to prevent accidental dispensing of beverage contents.

As shown in FIG. 27B, when the dispenser assembly 608 is in a dispensing state, the bottom fluid communication port

622 of the bottom beverage compartment 618 is in alignment with the third fluid communication port 634 at the top of the third fluid flow path 628 of the dispensing stem 624. The bottom fluid communication port 622 is brought into alignment with the third fluid communication port 634 by vertically displacing the dispensing stem 624 in the downward direction upon a lever 636 being depressed. Therefore, beverage contents stored in the bottom beverage compartment 618 are allowed to flow through the third fluid flow path 628 and be dispensed from the beverage dispenser 600. At the same time, the second fluid communication port 632 is vertically offset from the top fluid communication port 620 of the bottom beverage compartment 618, thereby preventing beverage contents from flowing into the bottom beverage compartment 618 from the beverage container or the top beverage compartment 612.

The top beverage compartment 612 and the bottom beverage compartment 618 may be separated from each other by a distance so as to allow thermal regulant to accumulate around both beverage compartments 612, 618. Moreover, the beverage compartments 612, 618 may have sloped or fluted upper walls to prevent the buildup of gas pockets within the beverage compartments 612, 618.

While described in conjunction with the sixth aspect of the disclosure, the dispenser assembly 608 or any of the components that comprise the dispenser assembly 608 may be used with any of the aspects of the disclosure.

While several aspects of the disclosure have been provided above, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components from one or more of the above described aspects of the disclosure may be combined or integrated together or in another system or certain features may be omitted or not implemented. Similarly, any of the various element or components described in conjunction with one of the above aspects of the disclosure may be combined with or replace corresponding elements or components of any of the other aspects of the disclosure. For example, any of the thermal tray 106, thermal drawers 161, 165, or thermal package 177 described in conjunction with the first aspect of the disclosure may be used in conjunction with or in replacement of the fixed thermal areas 201, 302 in the second and third aspects of the disclosure or any other aspects of the disclosure. Other replacement or swapping of components or elements of the various aspects of the disclosure will readily be apparent to one of ordinary skill in the art and are fully contemplated by this disclosure.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A beverage dispenser, comprising:

a dispensing shelf configured to support installation of one or more ready to drink beverage containers for gravity fed beverage dispensing;

a thermal regulant storage area adapted to store a thermal regulant that regulates the temperature of beverage contents of the one or more ready to drink beverage containers through natural convection;

a thermally insulated beverage compartment that encloses the thermal regulant storage area and at least a portion of the dispensing shelf configured to support installation of one or more ready to drink beverage containers; and a pre-regulating compartment positioned below the thermally insulated beverage compartment and adapted to store one or more pre-mixed beverage containers therein, wherein the dispensing shelf comprises an opening above the pre-regulating compartment to facilitate fluid communication between the pre-regulating compartment and the thermally insulated beverage compartment, and wherein the pre-regulating compartment comprises an aperture at an intermediate position along a rear surface of the pre-regulating compartment.

2. The beverage dispenser of claim 1, wherein the dispensing shelf comprises:

a beverage container mount on an upper side of the dispensing shelf; and a dispenser assembly on a lower side of the dispensing shelf.

3. The beverage dispenser of claim 2, wherein the dispensing shelf comprises an aperture adapted to facilitate installation of the beverage container mount and the dispenser assembly to the dispensing shelf.

4. The beverage dispenser of claim 1, wherein the thermally insulated beverage compartment encloses an upper side of the dispensing shelf.

5. The beverage dispenser of claim 1, wherein the dispensing shelf comprises a slanted surface that slopes towards the opening.

6. The beverage dispenser of claim 1, wherein the pre-regulating compartment is a drawer.

7. The beverage dispenser of claim 1, further comprising a modular beverage container storage compartment.

8. The beverage dispenser of claim 1, further comprising a front door, a top access door, or both.

9. The beverage dispenser of claim 1, wherein the thermal regulant storage area is fixed within the thermally insulated beverage compartment.

10. The beverage dispenser of claim 1, wherein the thermal regulant storage area is removable from the beverage dispenser.

11. The beverage dispenser of claim 10, wherein the thermal regulant storage area is one of a tray, a drawer, or a package.

12. The beverage dispenser of claim 1, wherein the thermal regulant storage area is perforated.

13. The beverage dispenser of claim 2, wherein the thermal regulant storage area surrounds at least a portion of the dispenser assembly.

14. The beverage dispenser of claim 1, further comprising:

a first door for accessing the thermally insulated beverage compartment; and a second door for accessing the pre-regulating compartment.

15. The beverage dispenser of claim 1, wherein the dispensing shelf and the pre-regulating compartment comprise overlapping geometries for trapping air or reducing airflow within the pre-regulating compartment.

16. The beverage dispenser of claim 1, wherein the pre-regulating compartment is configured to store a thermal regulant that regulates the temperature of beverage contents of the one or more pre-mixed beverage containers.

17. The beverage dispenser of claim 5, wherein the slanted surface that slopes towards the opening comprises at least one of a V-shape, a cone shape, a funnel shape, or a combination thereof.

18. The beverage dispenser of claim 1, further comprising a base aperture configured to be aligned with the aperture of the pre-regulating compartment to facilitate drainage of excess fluid from the pre-regulating compartment.

19. The beverage dispenser of claim 18, further comprising one or more seals disposed between the base aperture and the aperture of the pre-regulating compartment.

20. The beverage dispenser of claim 18, further comprising a drain hose attachable to the base aperture for carrying away the excess fluid from the pre-regulating compartment.

21. The beverage dispenser of claim 1, wherein the aperture of the pre-regulating compartment comprises a one way valve.

22. The beverage dispenser of claim 1, wherein the thermal regulant storage area comprises a thermal tray.

23. The beverage dispenser of claim 22, wherein the thermally insulated beverage compartment comprises a support self and a cam for rotating and supporting the thermal tray between a stowed position and an unstowed position.

24. The beverage dispenser of claim 23, wherein the thermal tray comprises a roller for engaging the cam.

25. The beverage dispenser of claim 22, wherein the thermal tray comprises a lid.

* * * * *